US006896475B2

(12) United States Patent
Graziosi et al.

(10) Patent No.: US 6,896,475 B2
(45) Date of Patent: May 24, 2005

(54) FLUIDIC ACTUATION FOR IMPROVED DIFFUSER PERFORMANCE

(75) Inventors: Paolo Graziosi, Clifton Park, NY (US); Richard Edwin Warren, Jr., Schenectady, NY (US); Thomas Frank Fric, Greer, SC (US); Ramani Mani, Niskayuna, NY (US); Douglas Carl Hofer, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 171 days.

(21) Appl. No.: 10/065,727

(22) Filed: Nov. 13, 2002

(65) Prior Publication Data

US 2004/0091350 A1 May 13, 2004

(51) Int. Cl.[7] ..... F01D 17/14

(52) U.S. Cl. ..... 415/1; 416/116; 416/211.2; 416/914; 416/144

(58) Field of Search ..... 415/1, 116, 144, 415/211.2, 224.5, 914

(56) References Cited

U.S. PATENT DOCUMENTS

| | | | | |
|---|---|---|---|---|
| 2,812,636 A | * | 11/1957 | Kadosch et al. | 239/265.17 |
| 3,047,208 A | | 7/1962 | Coandra | |
| 3,123,285 A | * | 3/1964 | Lee | 137/15.1 |
| 3,690,786 A | * | 9/1972 | Silvestri, Jr. | 415/169.4 |
| 3,719,430 A | | 3/1973 | Blair et al. | 415/207 |
| 3,885,891 A | | 5/1975 | Throndson | |
| 4,029,430 A | | 6/1977 | Fonda-Bonardi | 415/53 R |
| 4,132,499 A | | 1/1979 | Igra | |
| 4,448,354 A | * | 5/1984 | Reznick et al. | 239/265.17 |
| 4,487,366 A | * | 12/1984 | Davis et al. | 239/11 |
| 4,515,524 A | * | 5/1985 | Fisher, Jr. | 415/169.1 |
| 5,077,967 A | | 1/1992 | Widener et al. | 60/39.02 |
| 5,335,501 A | | 8/1994 | Taylor | 60/751 |
| 5,462,088 A | | 10/1995 | Poux et al. | 138/39 |
| 5,467,591 A | | 11/1995 | Bozzuto et al. | |
| 5,603,605 A | | 2/1997 | Fonda-Bonardi | 415/211.2 |
| 5,737,915 A | | 4/1998 | Lin et al. | 60/251 |
| 6,027,305 A | * | 2/2000 | Ng et al. | 415/119 |

FOREIGN PATENT DOCUMENTS

| | | |
|---|---|---|
| RU | 775355 | 11/1980 |
| RU | 832129 | 5/1981 |
| RU | 857517 | 8/1981 |
| RU | 969919 | 10/1982 |
| RU | 1109529 A | 8/1984 |
| RU | 1222859 A | 4/1986 |
| RU | 1321847 A1 | 7/1987 |
| RU | 1454991 A1 | 1/1989 |
| RU | 2050440 C1 | 12/1995 |
| RU | 2053373 C1 | 1/1996 |

OTHER PUBLICATIONS

UK Search Report under Section 17(5), dated Mar. 25, 2004.

Ball, W. H., "Tests of Wall Blowing Concepts for Diffuser Boundary Layer Control", AIAA/SAE/ASME 20th Joint Propulsion Conference, Jun. 11–13, 1984, Cincinnati, Ohio, pp. 1–8.

(Continued)

*Primary Examiner*—Ninh H. Nguyen

(74) *Attorney, Agent, or Firm*—Penny A. Clarke; Patrick K. Patnode

(57) ABSTRACT

A diffuser includes an opening along the diffuser wall for preventing or delaying boundary layer separation of the main flow. The opening may include a curved passageway having a curvature convex relative to the main flow for utilizing the Coanda effect. A gas turbine may include the diffuser with an opening and a centerbody with an opening, each for providing a secondary flow of fluid into the diffuser. The gas turbine may direct fluid from an upstream turbine stage to the opening. A steam turbine may include the diffuser and may situate the opening downstream the diffuser inlet but upstream the location of boundary separation.

58 Claims, 26 Drawing Sheets

OTHER PUBLICATIONS

Fiedler, R.A. and F.B. Gessner, "Influence of Tangential Fluid Injection on the Performance of Two–Dimensional Diffusers", Journal of Basic Engineering, Transactions of the ASME, Sep. 1972, pp. 666–674.

Kwong, Anthony H.M. and Ann P. Dowling, "Active Boundary–Layer Control in Diffusers", AIAA Journal, vol. 32, No. 12, Dec. 1994, pp. 2409–2414.

Nicoll, W.B. and B.R. Ramaprian, "Performance of Conical Diffusers with Annular Injection at Inlet", Journal of Basic Engineering, Dec. 1970, pp. 827–835.

Raghunathan, S. et al., "Short Wide Angle Diffuser With Pulse Jet Control", 37th AIAA Aerospace Sciences Meeting and Exhibit, Jan. 11–14, 1999, Reno, Nevada, pp. 1–7.

* cited by examiner

◆ Test ('81) - model (1:7.1), T0 amb, no inlet swirl

■ CFD - full scale, T0=1461.4 R, no exit radial vanes, uniform inlet profiles, no inlet swirl ▲ CFD - full scale, T0=1461.4 R, no exit radial vanes, CAFD inlet profiles and swirl

FIG. 13

- Baseline turbine work $$W_b = \dot{m}C_p(T_0^i - T_0) = \dot{m}C_pT_0^i\left[1-\left(\frac{P_0}{P_0^i}\right)^{e_t\frac{\gamma-1}{\gamma}}\right]$$

- Augmented turbine work $$W_a = \dot{m}C_p(T_0^i - T_0') - \dot{m}_BC_p(T_0^B - T_0') = \dot{m}\,C_pT_0^i\left\{\left[1-\left(\frac{P_0'}{P_0^i}\right)^{e_t\frac{\gamma-1}{\gamma}}\right] - \frac{\dot{m}_B}{\dot{m}}\left(\frac{P_0^B}{P_0^i}\right)^{e_t\frac{\gamma-1}{\gamma}}\left[1-\left(\frac{P_0'}{P_0^B}\right)^{e_t\frac{\gamma-1}{\gamma}}\right]\right\}$$

- Net turbine work gain (figure of merit)

$$\frac{W_{gain}}{W_{turbine}} = \frac{W_a - W_b}{W_b}$$

Net gain in turbine work extraction

FIG. 16

- Baseline turbine work $$W_b = \dot{m}C_p(T_0^i - T_0) = \dot{m}C_pT_0^i\left[1-\left(\frac{P_0}{P_0^i}\right)^{e_t\frac{\gamma-1}{\gamma}}\right]$$

- Augmented turbine work $$W_a = \dot{m}C_p(T_0^i - T_0') = \dot{m}C_pT_0^i\left[1-\left(\frac{P_0'}{P_0^i}\right)^{e_t\frac{\gamma-1}{\gamma}}\right]$$

- Blowing work (booster)

$$W_B = \dot{m}_BC'_p(T_0^B - T_{amb}) = \dot{m}_BC'_pT_{amb}\left[\left(\frac{P_0^B}{P_{amb}}\right)^{\frac{\gamma'-1}{\gamma' e_c}}-1\right]$$

- Net turbine work gain (figure of merit)

$$\frac{W_{gain}}{W_{turbine}} = \frac{W_a - W_B - W_b}{W_b}$$

14 deg geometry, no struts, no radial vanes

FLUIDIC ACTUATION FOR IMPROVED DIFFUSER PERFORMANCE

BACKGROUND OF THE INVENTION

This invention generally relates to a fluidic actuating scheme, and more particularly, this invention relates to fluidic actuation for improved diffuser performance.

Typically, the maximum outlet to inlet area ratio of a gas turbine exhaust diffuser (and therefore the amount of effective flow diffusion following the last turbine stage) is constrained by flow separation issues and/or allowable axial diffuser length. Diffuser will exhibit separated flow if the expansion is too rapid (large diffuser angle) or the diffuser area ratio is too large.

For a given diffuser length, the area ratio is determined by the diffuser expansion angle. The maximum included angle, which can be tolerated before significant flow separation occurs, is generally of the order of 10 degrees. For diffusers that are not limited in length, the maximum area ratio that can be tolerated before significant separation occurs is generally of the order of 2.4 (outlet area divided by inlet area). For attached flow the pressure recovery is a function of area ratio and increases as area ratio increases. For turbine exhaust systems, any constraint on the exhaust diffuser area ratio imposes a limitation on maximum amount of work that can be extracted by the turbine.

A design that would allow larger diffusion angles without flow separation within the same or less axial length would provide larger areas ratios, improved pressure recovery, and increased gas turbine efficiency. For systems that already have acceptable pressure recovery the result could be significantly reduced diffuser length. Presently the exhaust diffusion system on an F-class gas turbine takes up approximately half of the overall gas turbine length.

Finally, diffuser performance as it relates to pressure recovery can be strongly affected by the diffuser inlet flow profile. For a typical F-class gas turbine the inlet flow profile varies as a function of machine load and amount of power produced. Turbine diffusers are designed to achieve the highest pressure recovery at full load operating conditions. At part load conditions, due to off-design inlet flow profiles and resulting flow separations, the pressure recovery of the diffuser can be degraded by a factor of 3.

Similarly, the performance of a steam turbine exhaust system is limited by geometry constraints and flow separation issues. For example, the down flow hood axial length cannot be increased without changing the bearing span of the machine rotor and the maximum area ratio allowable through the steam guide flow path, before flow separation occurs, yields a low value of the pressure recovery coefficient of 0.3 for the whole exhaust hood. For one type of an axial flow diffuser used in steam turbines, the maximum included angle that can be tolerated before significant separation (and losses) occurs is of the order of 10–15 degrees. This issue, in addition to constraints on the length of the diffuser, limits the exhaust pressure recovery coefficient to a value of 0.25–0.3.

Previously, options which have been identified to improve diffuser performance relative to conventional designs include use of splitter vanes, vortex generators and wall riblets. Splitter vanes have the disadvantage of increasing skin friction (and therefore losses) and appear to work relatively well only for uniform inlet flows. Inlet swirl, for instance, can substantially deteriorate the performance. Vortex generators and other passive devices need a high momentum core flow to re-energize the boundary layer and delay separation. In principle, they are expected to fail to yield a substantial increase in diffuser performance if, as it is the case downstream of the last turbine stage at the diffuser inlet, the diffuser inlet flow profile is severely skewed and characterized by large regions of low momentum fluid in the vicinity of the separation point. Evidence of diffuser performance improvement due to the use of ribs/riblets on the diverging diffuser walls is uncertain.

BRIEF SUMMARY OF THE INVENTION

The above discussed and other drawbacks and deficiencies are overcome or alleviated by a diffuser augmented with fluidic actuation, the diffuser having a longitudinal axis, a diffuser inlet having a width W, a diverging section having a diffuser wall, an opening in the diffuser wall adjacent the diffuser inlet, and a curved passageway adjacent the opening, wherein the curved passageway is curved convexly relative to the longitudinal axis, the curved passageway for introducing a secondary jet into the opening and along the diffuser wall for maintaining the secondary jet along the wall using the Coanda effect.

In another embodiment, a gas turbine having a diffuser augmented with fluidic actuation includes a diffuser inlet through which passes a main flow of air in a main flow direction, a diverging section having a diffuser wall, a centerbody placed within the diverging section, at least one opening in the diffuser wall adjacent the diffuser inlet, and at least one opening in a wall of the centerbody in a vicinity of the diffuser inlet.

In another embodiment, a gas turbine having a diffuser augmented with fluidic actuation includes a diffuser inlet placed adjacent the turbine, a diverging section having a diffuser wall, an opening in the diffuser wall, an exit port in the turbine, the exit port separate from a main turbine exit, and an airway extending from the exit port to the opening, wherein air is extracted from the turbine and introduced into the diverging section.

In another embodiment, a steam turbine includes a final turbine stage, an axial flow diffuser receiving a main flow from the final turbine stage, a diverging wall in the axial flow diffuser, the diverging wall extending from a diffuser inlet to a diffuser exit, a centerbody in the axial flow diffuser, an opening in the diverging wall and an opening in the centerbody for fluidically actuating the main flow, wherein the openings are located downstream from the diffuser inlet and upstream from a point where boundary layer separation would occur along the walls in a diffuser without the openings.

In another embodiment, a steam turbine includes a final turbine stage, a down-flow exhaust hood, a centercone in the down-flow exhaust hood, a steam guide passage in the down-flow exhaust hood receiving a main flow of air from the final turbine stage, and an opening in the steam guide for fluidically actuating the main flow, wherein the opening is located downstream from the steam guide inlet and upstream from a point where boundary layer separation would occur along a steam guide without the opening.

In another embodiment, a method of improving diffuser performance includes allowing a main flow to pass through the diffuser, providing an opening in a diffuser wall, selecting a fluid source, injecting fluid into the opening for preventing separation of the main flow from the diffuser wall, and directing the fluid at an angle relative to the main flow and relative to the diffuser wall which will maximize effectiveness.

The above discussed and other features and advantages of the present invention will be appreciated and understood by those skilled in the art from the following detailed description and drawings.

BRIEF DESCRIPTION OF THE DRAWINGS

FIG. 13 shows the formulae for deriving Wgain/Wturbine for FIG. 12;

FIG. 16 shows the formulae for deriving Wgain/Wturbine for FIG. 15;

DETAILED DESCRIPTION OF THE INVENTION

This design employs fluidic actuation to allow turbine diffusers to be designed with one or all of the following attributes: for a given value of area ratio, design shorter diffusers to reduce cost and minimize turbine length; for a given value of diffuser length, increase the expansion angle (area ratio) to improve diffuser performance and increase turbine efficiency; retrofit fluidic actuators to existing diffusers that have separated flow to improve performance at all operating conditions (e.g. full load and part load).

By applying fluidic actuation to a separated diffuser flow, it is shown below that exhaust diffuser pressure recovery can be significantly improved at different operating conditions.

A description of a fluidic actuating scheme, designed to improve diffuser performance, may be given in reference to an idealized two-dimensional diffuser geometry. Results of numerical flow simulations are discussed below. For the cases studied, the main diffuser flow separates at the inlet of the diverging section of the duct because of the large diffuser angle.

Figure 1:
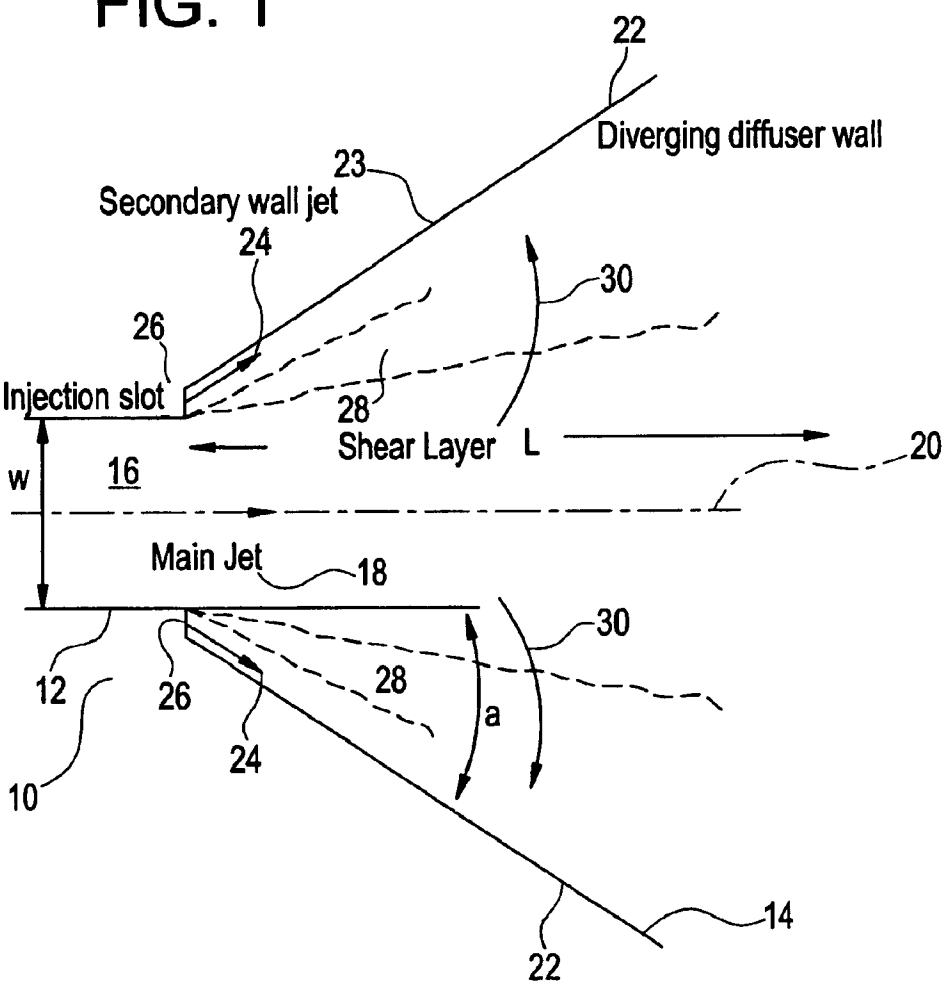
FIG. 1 shows a diagram of a 2D diffuser with fluidic actuation (inlet blowing)

Turning to FIG. 1, a diffuser 10 is shown having a first end 12 and a second end 14. The first end 12 defines the diffuser inlet 16 which receives the main flow 18 from the gas/steam turbine or other engine upstream from the first end 12. While the main flow 18 is shown flowing along the longitudinal axis 20 of the diffuser 10, it should be understood that the main flow 18 fills the width w of the diffuser inlet 16. The diffuser 10 further includes a diverging diffuser wall 22 defining a diverging section 23. The performance (pressure recovery) of the diffuser depends on the area ratio across the diffuser. As long as the boundary layer flow developing along the diffuser walls remains attached to the wall surfaces, a larger area ratio results in higher pressure recovery. For a given length, the area ratio of diffuser 10 is determined by the angle $\alpha$ that the diffuser wall 22 forms with the axis of the diffuser 20. Also, for a given area ratio, the diffuser length is determined by the angle $\alpha$. Increasing the angle $\alpha$, for a given area ratio, results in a shorter diffuser with associated cost benefits. However, typically, boundary layer separation from diffuser walls 22 forces the angle $\alpha$ to be smaller than optimal for performance. To reduce the size of the separation regions and therefore increase the pressure recovery along the wide-angle diffuser 10, secondary steady air flows 24 are injected simultaneously from two small (relative to the main jet thickness) longitudinal slots 26 placed along the lower and upper walls at the inlet 16 of the diffuser 10. With proper design of the injection slots 26, wall jets 24 of small thickness develop parallel to the upper and lower diverging diffuser walls 22 as shown in FIG. 1. The total pressure (and consequently mass flow and momentum) of the fluidic actuators (secondary flows 24) is assumed to be controllable.

The aerodynamic interaction between the main diffuser flow 18 and the secondary wall jets 24 substantially alters the overall flow pattern. The wall jets 24 energize the shear layer 28 that is formed between the core flow and the recirculating flow, causing a delay of the flow separation itself. The core flow widens, as indicated by arrow 30, along the cross-flow direction, and a larger static pressure recovery is achieved. As will be described below, the reduction of the size of the separation region and the corresponding increase in diffusion depends on the ratio between the total injected mass flux and the mass flux of the main diffuser flow.

Results of numerical simulations are presented where the fluidic actuation technique using secondary wall jets 24 from FIG. 1 is proved to enhance a diffuser performance. As a measure of diffuser performance, the static pressure at the inlet 16 of the diverging section 23 can be used. Since the static pressure at the diffuser exhaust is typically fixed, a lower static pressure at the turbine exit (diffuser entrance 12) is achieved by increasing the recovery along the diffuser diverging section 23, namely by reducing the size of separation regions (and corresponding losses) within the diffusing flow or by eliminating separation all together in the wide-angle diffuser.

Figure 2:
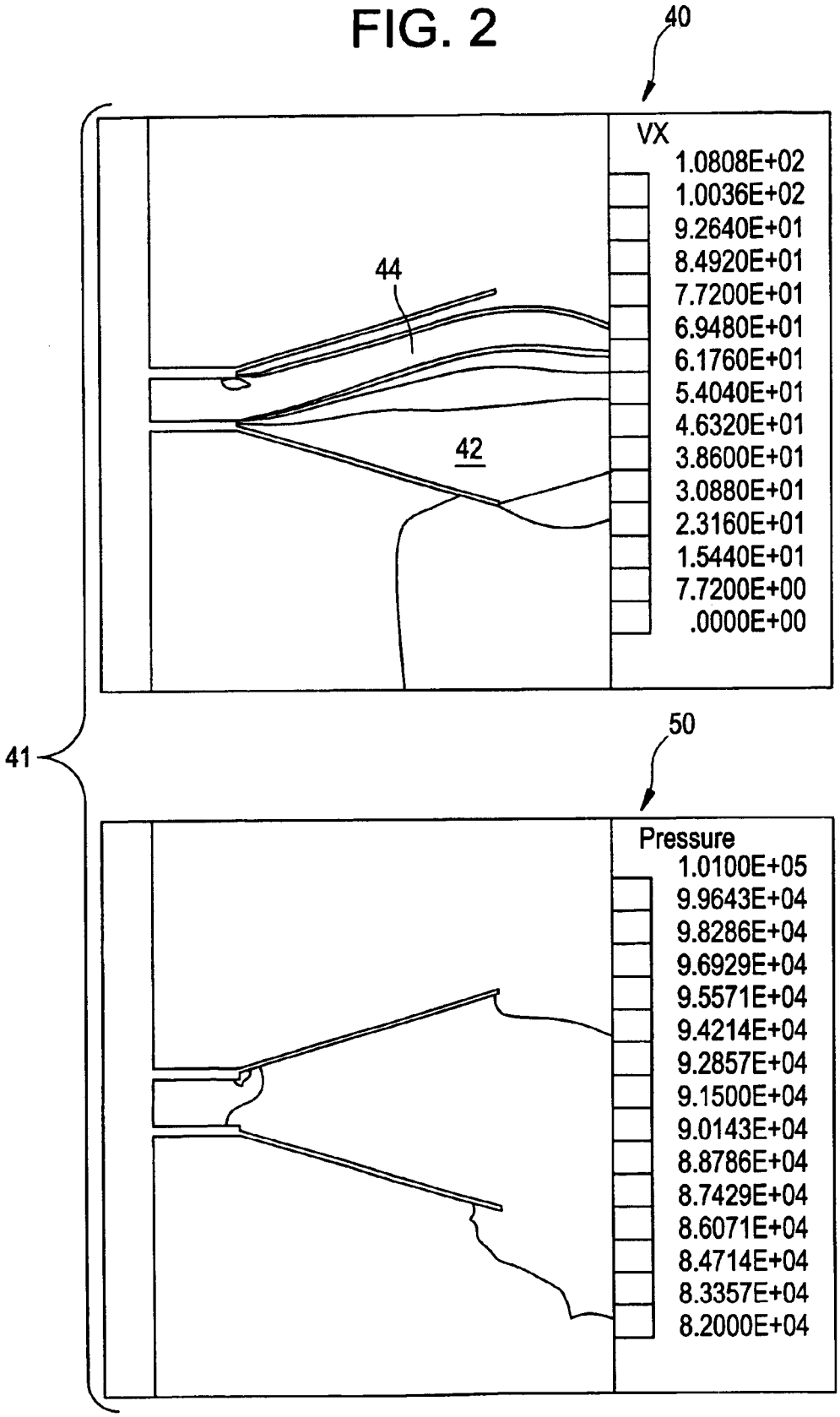
FIG. 2 shows an axial velocity contour plot from a computer simulation of a 2D diffuser without fluidic actuation.
Figure 3:
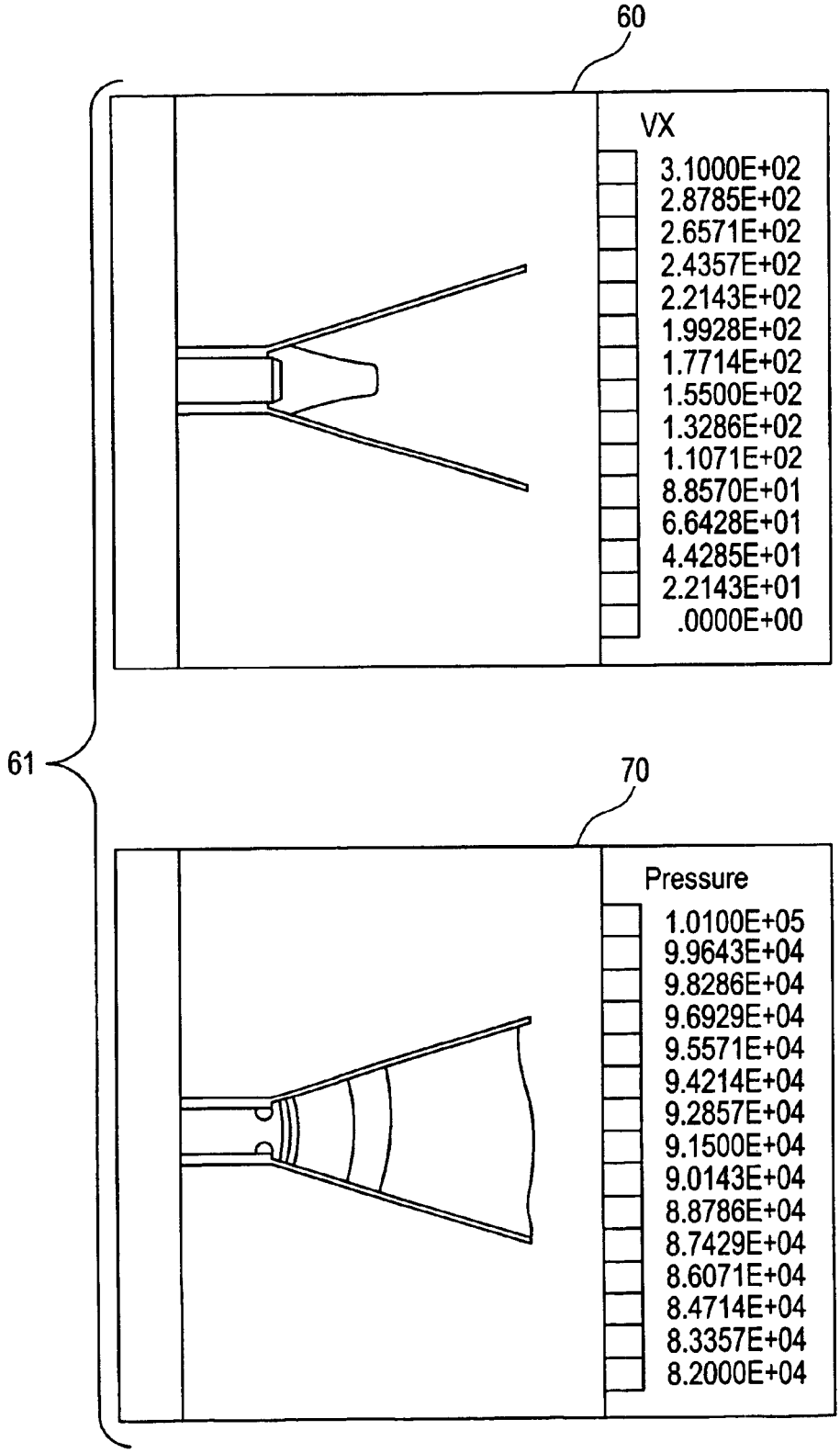
FIG. 3 shows an axial velocity contour plot from a computer simulation of a 2D diffuser with fluidic actuation (inlet blowing)
Figure 4:
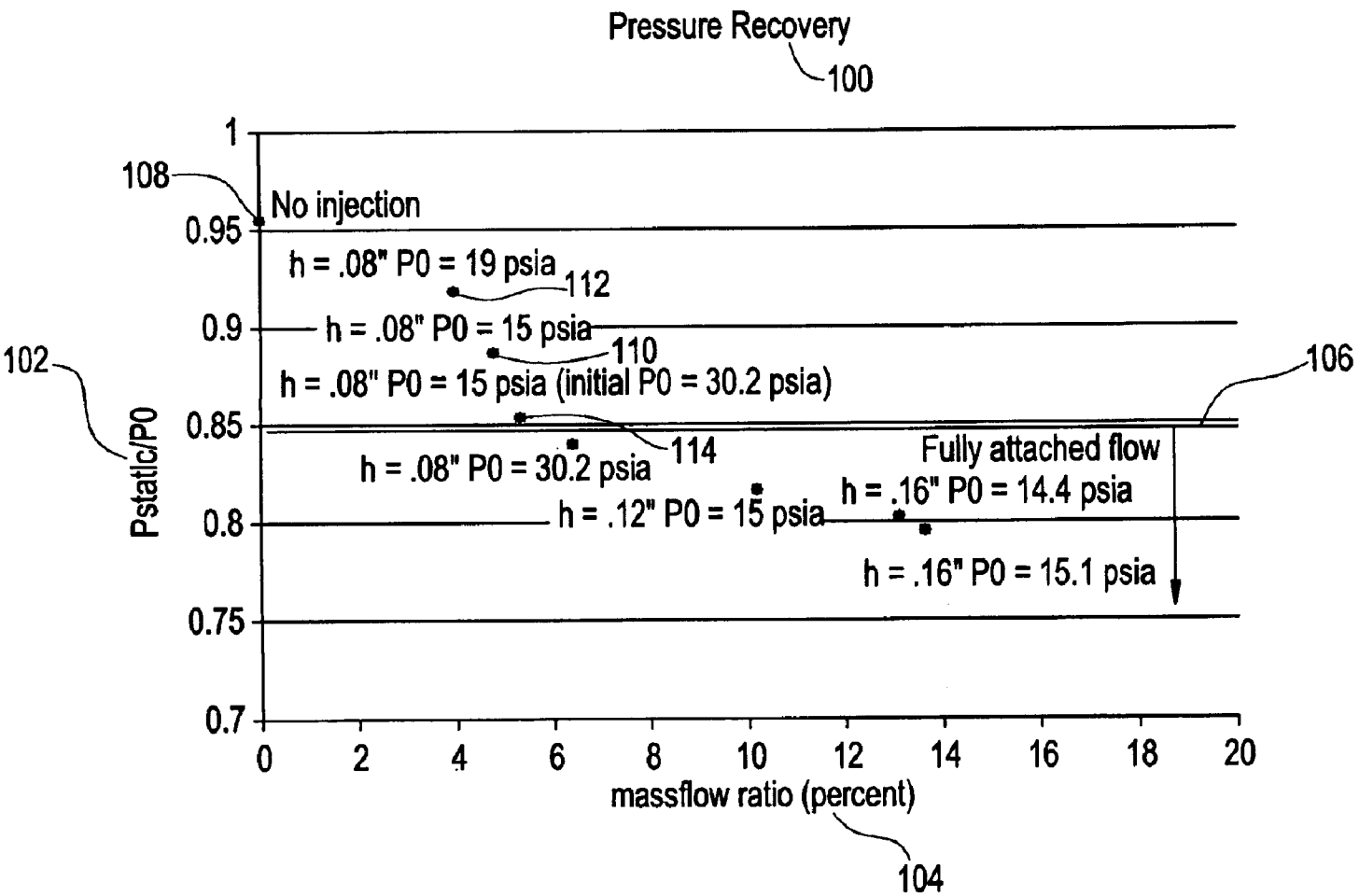
FIG. 4 shows a graph of pressure recovery vs. mass-flow ratio of injection for a 2D diffuser.

FIG. 2 shows the axial velocity contour plot 40 and the static pressure contour plot 50 for a two dimensional 15 degree angle ($\alpha$) diffuser flow. Although a two dimensional diffuser is not an actual employable embodiment, the results of computer simulations show an exemplary demonstration of the effectiveness of the fluidic actuation scheme described above. With reference to FIG. 1 for the parts of a diffuser 10, the inlet height, such as w of inlet 16, is 2.7" and the length L of the diverging walls 22 is 25" for the diffuser under study (FIGS. 2–4). The total pressure of the main flow 18 is 15.1 psia and the exit pressure, that is, the static pressure at second end 14 of diffuser 10, is fixed at atmospheric conditions (14.7 psia). A large separation region 42 (white area in the plot of FIG. 2), which originates at the inlet 16 of the diverging section 23, characterizes the flow. As a result of the separation pattern 42, the core flow 44 attaches on the upper wall and the pressure recovery is minimal, as deduced from plot 50. The inlet Mach number is approximately 0.26.

The axial velocity contour plot 60 and static pressure contour plot 70 for the 15 degree diffuser flow with secondary parallel film (jet) injection are displayed in FIG. 3. The stagnation conditions and the exit static pressure of the main flow 18 are the same as for the simulation of FIG. 2. The total pressure of the secondary films (e.g. secondary wall jets 24 as shown in FIG. 1) is 15.1 psia and the height of the slots, as measured perpendicularly from the longitudinal axis 20, is 0.16". As appears from FIG. 3, the velocity contour plot 60 displays no evidence of recirculating flow anywhere within the diffuser geometry and the static pressure at the diffuser inlet section 16 is much lower than for the case with no film injection (FIG. 2) (the pressure range in FIG. 2 is the same as the one in FIG. 3 to allow a direct performance comparison). The velocity contour plot 60 clearly illustrates the aerodynamic interaction which takes place between the main flow 18 and the secondary jets 24: "wings" of high velocity fluid develop adjacent to the walls (wall jets) while the core of the main flow widens in the cross-flow direction along the diffuser centerline 20. Because of the larger pressure recovery as deduced from plot 70 and from the fact that the static pressure at the exit of the diffuser is fixed, the inlet Mach number of the main flow 18 increases to approximately 0.55 (and so does the mass flow).

Thus, it is possible to manipulate a large mass-flux flow through a wide-angle diffuser by injecting small secondary air flows 24 at a total pressure approximately equal to the stagnation pressure of the main flow 18. It is important to notice that the momentum of the secondary jet 24 (one of the principal scaling parameters which determines the intensity of the aerodynamic interaction) depends on the pressure ratio across the slot 26 (slot Mach number) beside the total pressure of injection. As the overall flow pattern changes due to the aerodynamic interaction between the films 24 and the main flow 18, the size of the separation region decreases and consequently the static pressure at the inlet 16 of the diverging section 23 decreases. The inlet Mach number of the secondary jets 24 increases because of the larger pressure ratio across the slot 26, (the slot total pressure is fixed) and so does the injected momentum. It is interesting to notice that the slot flow is choked (Mach=1) for the results of the simulation presented in FIG. 3.

An important parameter for application related issues is the mass-flux ratio (the average mass-flux of the secondary jets divided by the mass-flux of the main flow, where mass-flux, for example, may be measured in Kg per sec, or lb per hour) needed to achieve a certain degree of diffuser performance.

The diffuser performance parameter 102 versus the mass-flux ratio 104 (i.e. the mass-flow ratio) is displayed in FIG. 4. Fully attached flow and large pressure recovery is achieved for Pstatic/PO<0.85 (below the line 106 in FIG. 4). A point 108 corresponding to zero injection (and fully separated main flow) is also shown in the plot 100 for reference. The pressure recovery increases monotonically (the inlet static pressure decreases at fixed exit static pressure and inlet total pressure) as the mass flow ratio increases. Also, a lower inlet static pressure is achieved for an injection total pressure equal to 15 psia than for a total pressure of 19 psia (for a fixed slot height of 0.08"), as demonstrated by points 110 and 112, respectively. This appears to indicate a lower effectiveness of fluidic actuation as the blowing total pressure increases substantially. Furthermore, different pressure recovery is achieved at PO(film)=15 psia and h=0.08" depending on the initial conditions. As shown in FIG. 4, a larger injected mass-flow and a larger pressure recovery are obtained if the injected total pressure is first set at 30.2 psia and then decreased to 15 psia than if a slot total pressure of 15 psia is imposed for the entire course of the calculation (as demonstrated by points 110 and 114 in FIG. 4). This may be a result of aerodynamic hysteresis which can be beneficial in the case where a large injection total pressure cannot be conveniently maintained over time but can be applied for a short time at start up.

Secondary wall blowing 24, as well as suction, may be used to improve the performance of a gas turbine exhaust diffuser. Aggressive diffuser geometries, that is, higher included angle for a given length and shorter diffusers for a given area ratio, are proposed where flow control, as described above with respect to FIGS. 1–4 for an ideal 2D diffuser geometry, is used to prevent separation and exploit the potential increase in pressure recovery relative to conventional designs. Issues such as blowing/suction source and geometry of blowing/suction ports, important for the practical implementation of the flow control technology to simple cycle and combined cycle ground based gas turbine annular exhaust systems, will now be considered.

The performance of ground based gas turbines often suffers from poor pressure recovery through the exhaust system. Typically, the maximum outlet to inlet area ratio of a gas turbine exhaust diffuser (and therefore the amount of effective flow diffusion and pressure recovery following the last turbine stage) is constrained by flow separation issues and/or allowable axial diffuser length. Diffuser will exhibit separated flow if the expansion is too rapid (diffuser angles larger than 10 degrees) or the diffuser area ratio is too large (larger than 2.4). Any constraint on the area ratio imposes a limitation on maximum amount of work that can be extracted from the turbine.

Figure 5:
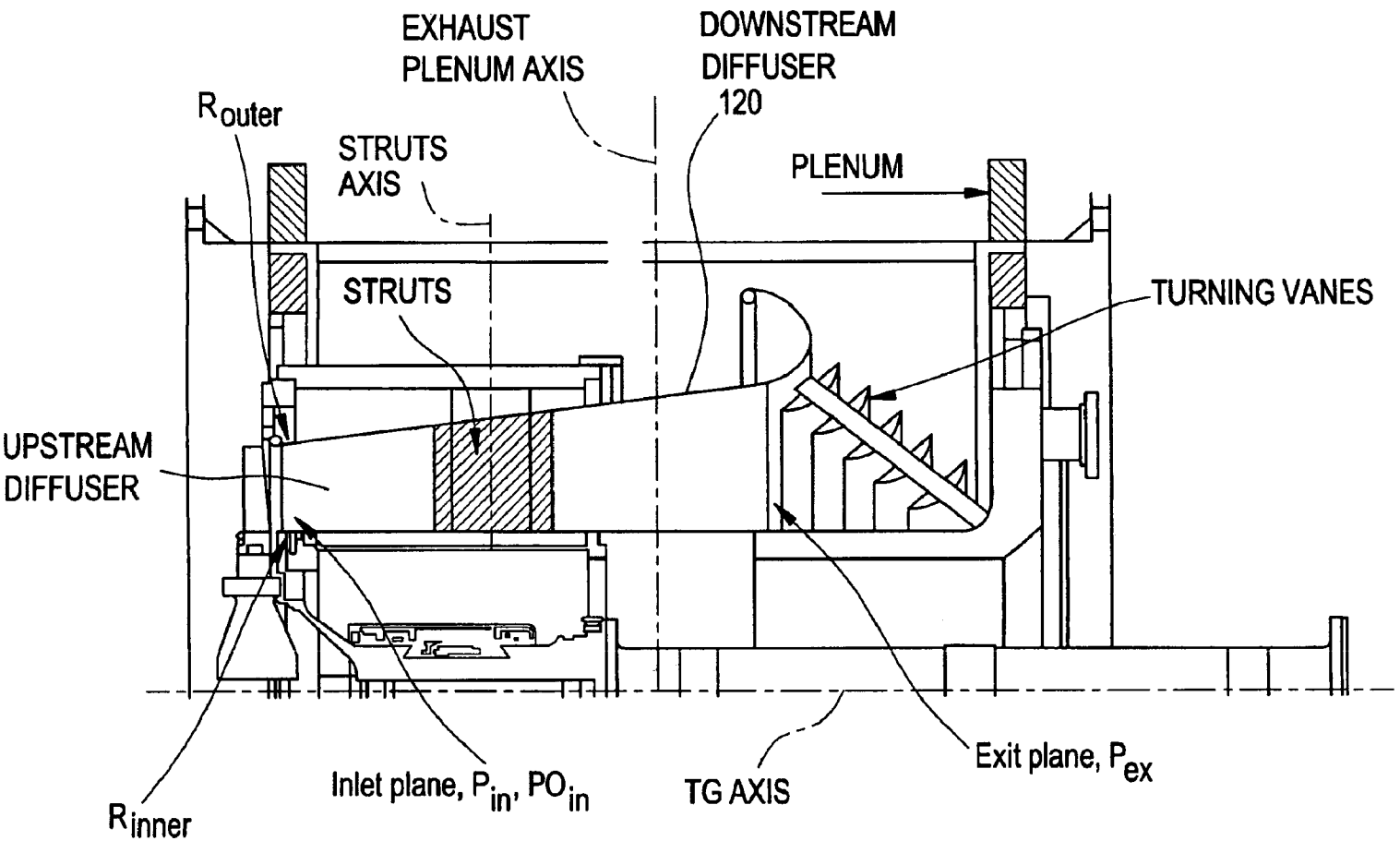
FIG. 5 shows a diagram of an exhaust diffuser for a gas turbine engine.

For exemplary purposes only, FIG. 5 shows an exhaust diffuser 120 used on a General Electric machine, the 7EA, however it should be understood that other exhaust systems can be augmented by the proposed blowing actuation scheme and the specific examples denoted herein should not be deemed, limiting as the various possibilities for applications. The exhaust geometry shown in FIG. 5 is an example of an exhaust diffuser whose length is constrained by the presence of the generator downstream.

For FIGS. 5–9, the following definitions should be noted, with reference to FIG. 5:

Non dimensional radius: Rnondim=(R−Rinner)/(Router−Rinner)

Pressure recovery coefficient (where P static pressure and P0 total pressure):

$$Cp=(P\text{ex}-P\text{in})/(P\mathbf{0}\text{ in}-P\text{in})$$

Injection total pressure: P0B

Injection mass-flow rate. mB

Diffuser main mass-flow rate: m

Mass-flow rate ratio: mR=mB/m

Injection slot height: h

Figure 6:
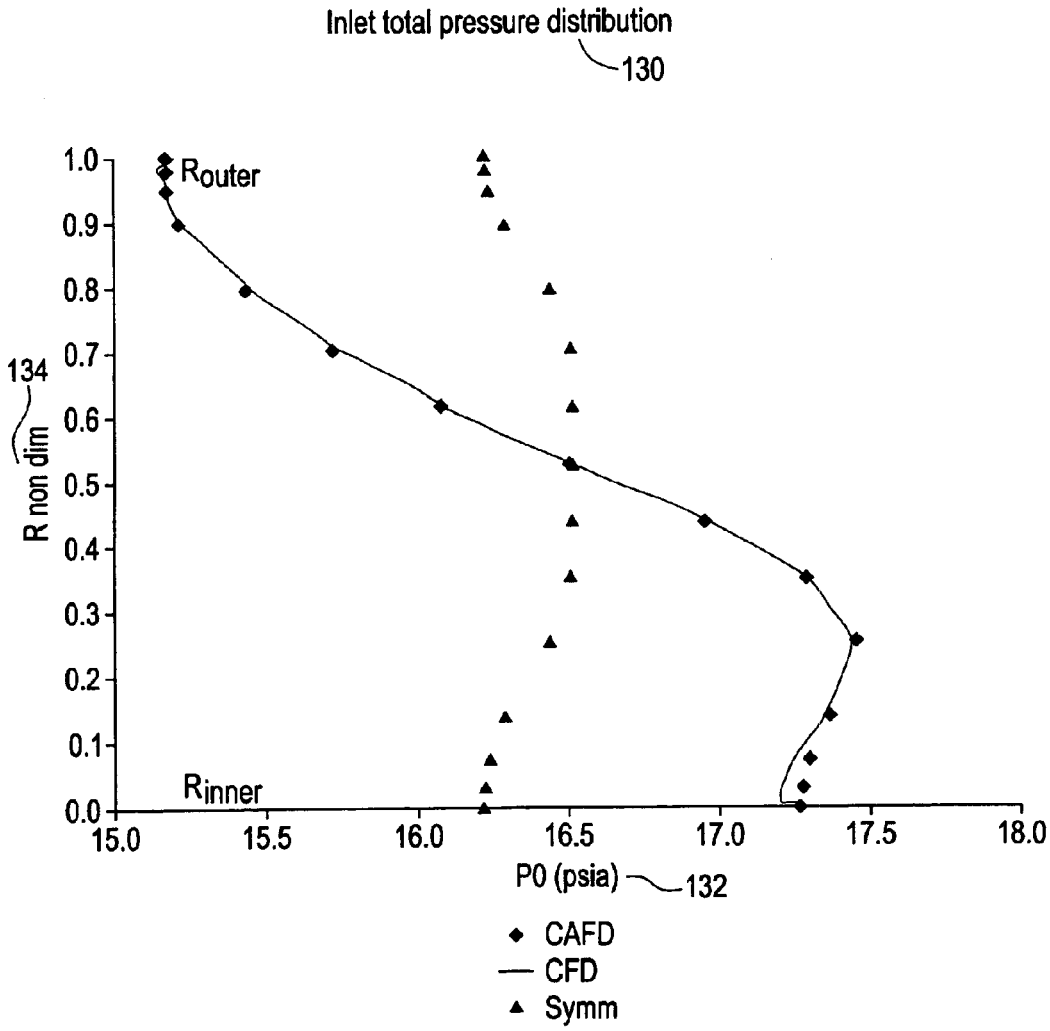
FIG. 6 shows a graph of two inlet total pressure distributions used for the numerical study of the diffuser.

Turning to FIG. 6, a plot of diffuser inlet total pressure distribution 130 is shown with total pressure P0 132 plotted against non dimensional radius 134 Rnondim, as defined above. Three inlet flow distribution options are shown, CAFD total pressure profile (CAFD design tool analysis of actual 7EA machine operating conditions), a symmetric total pressure distribution (used to test scheme robustness relative to different inlet flow distributions) and uniform inlet P0.

Figure 7:
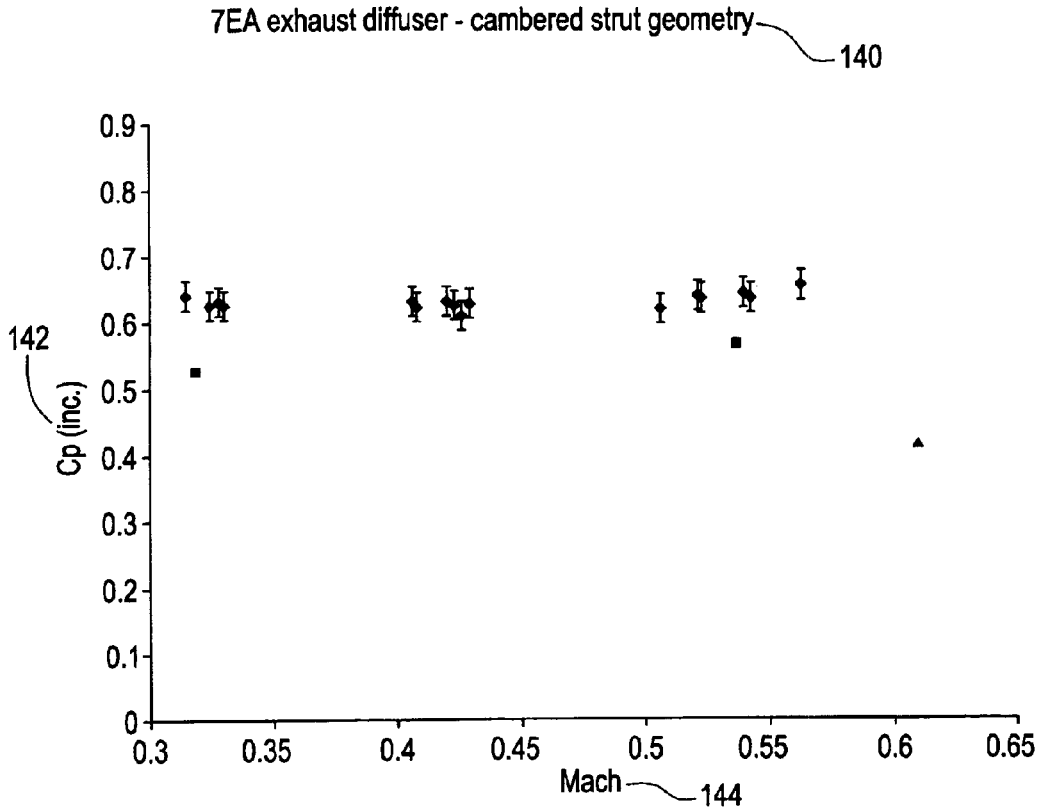
FIG. 7 shows a graph of Cp versus Mach for a diffuser having struts including results from both experiments and numerical simulations.
Figure 8:
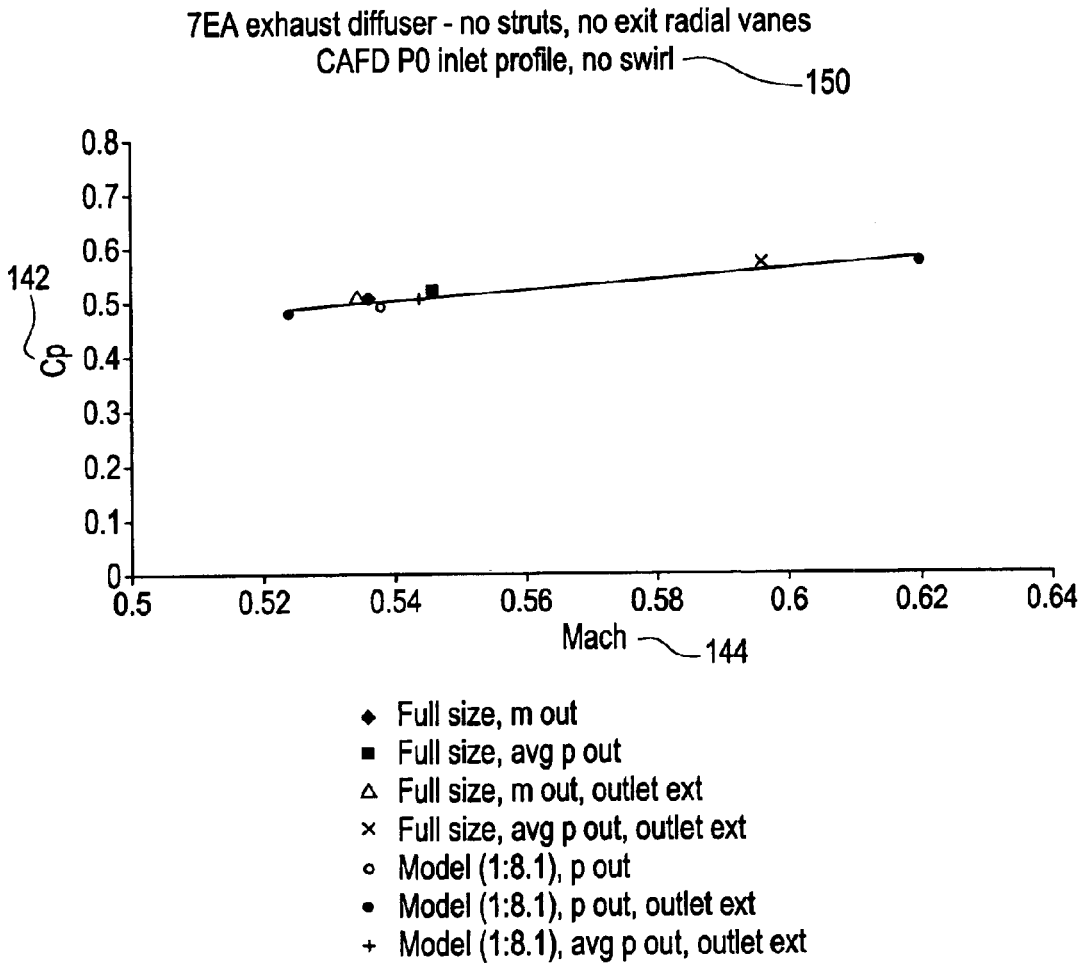
FIG. 8 shows a graph of Cp versus Mach for a diffuser without struts and radial vanes.

A plot 140 of pressure recovery coefficient Cp 142 (as defined above) versus Mach number 144 is shown in FIG. 7 for a nominal diffuser having a cambered strut geometry. Results of tests and computer simulation (computational fluid dynamics "CFD") are included for a scale model and a full scale 7EA diffuser. It is here noted that the inlet P0 profile considerably affects diffuser performance. Performance drops markedly for "weak" inlet profiles (e.g. CAFD inlet profile). Similarly, a plot 150 of Cp 142 versus Mach number 144 is shown in FIG. 8 (CFD results) for a 7EA diffuser having no struts, no exit radial vanes, and no inlet swirl. These plots show that results for the scale model are applicable to full size machines and prove the CFD tool robustness relative to choice of outlet boundary conditions.

In an aggressive (higher wall angle) annular diffuser geometry, high momentum jets are injected parallel to the diverging diffuser wall and possibly along the centerbody wall to energize the boundary layer flow and prevent separation. Diffusers can be designed with more aggressive shapes (higher area ratio) and the result is an improvement in pressure recovery and machine performance. Options for the blowing air source may include upstream turbine stages, independent booster unit (which may pose less penalty because of lower temperature of blowing air), upstream compressor stages, and ambient air (the greatest benefit of the latter option is the fact that it poses no penalty on the engine cycle).

Figure 9:
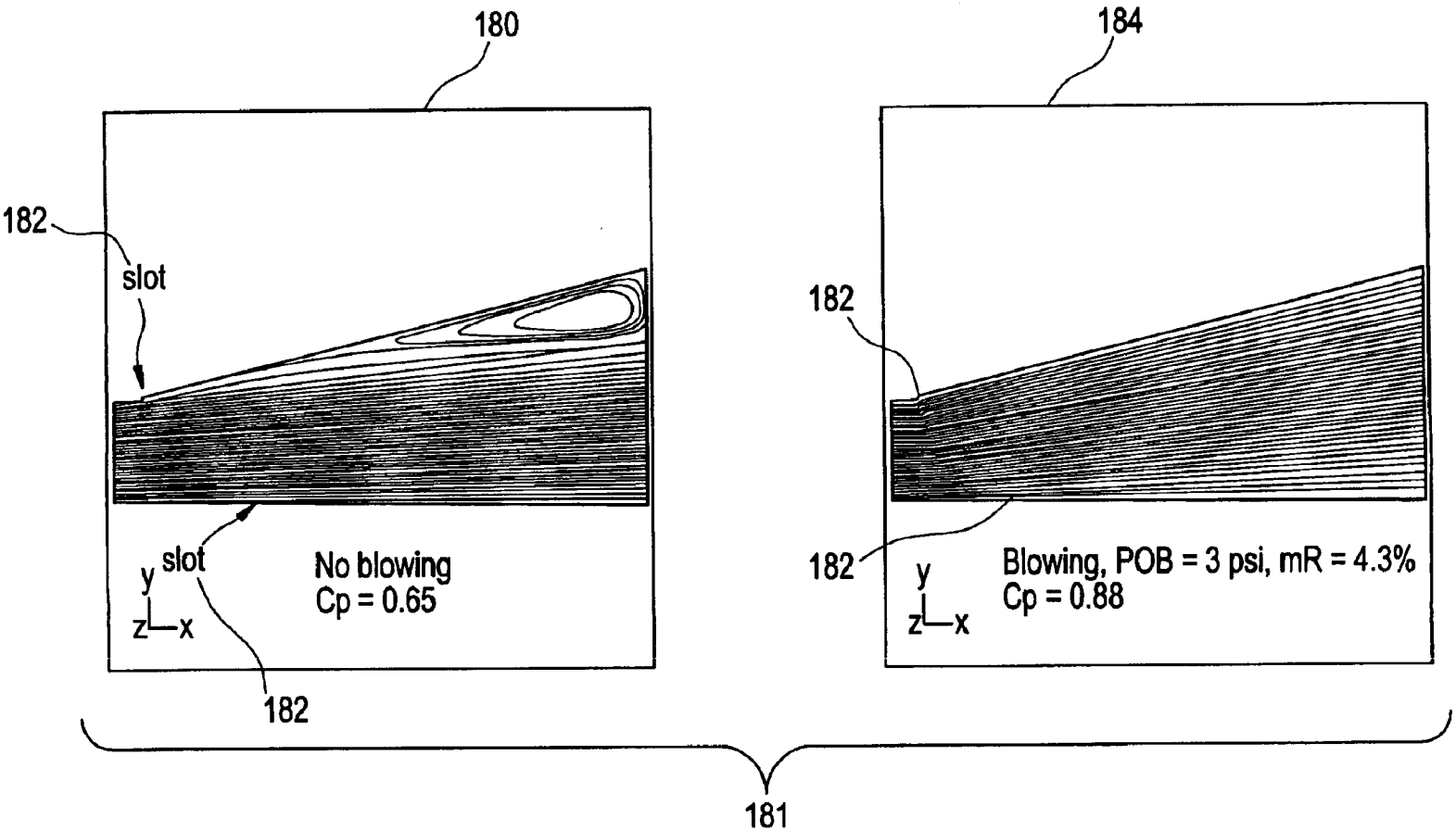
FIG. 9 shows velocity contour plots of a wide-angle (14 deg) annular diffuser without and with inlet blowing.

FIG. 9 shows velocity contour plots from results of computer simulations of the flow through a 14 deg angle annular diffuser model. With no blowing through slots 182 (plot 180) (double slot configuration, slot height=0.035", Mach=0.53, symmetric P0 inlet profile, exit ambient p) the performance of the diffuser is adversely affected by flow separation from the outer wall: Cp is only 0.65. When blowing is introduced through slots 182 (plot 184), outer wall flow separation is removed and Cp is 0.88, a 35% increase in pressure recovery coefficient.

Figure 10:
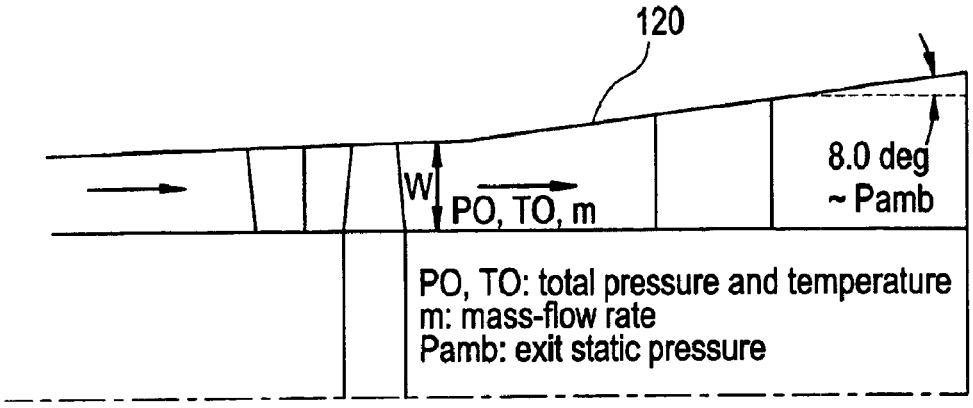
FIG. 10 shows a simplified diagram of the diffuser of FIG. 5.
Figure 11:
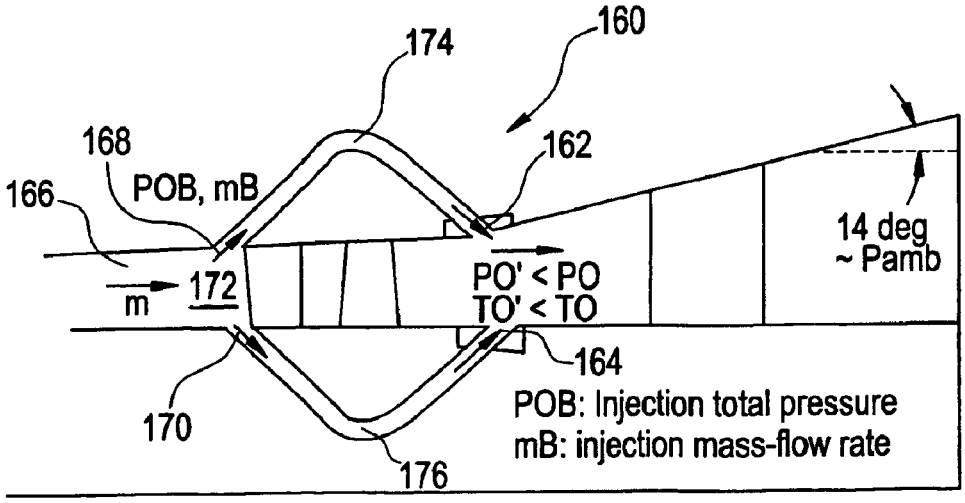
FIG. 11 shows a diagram of an exhaust annular diffuser augmented with fluidic actuation (inlet blowing) using turbine air extraction.

FIG. 10 shows a schematic of the exhaust diffuser 120 of FIG. 5 having a nominal diverging wall angle of 8 degrees (current configuration used in the 7EA gas turbine), where P0, and T0 represent total pressure and temperature, m the mass-flow rate, and Pamb the exit static pressure. Because of the length constraint, the pressure recovery coefficient is only about 0.5–0.6 (FIGS. 7, 8). To improve performance for the given axial length the diverging wall angle is increased from the nominal value of 8 degrees to a value of 14–15 degrees with a corresponding increase in area ratio, as shown in the augmented diffuser 160 of FIG. 1. Blowing may be applied at the diffuser inlet around the circumference of the outer wall and center-body to prevent flow separation. As shown in FIG. 11, the air blowing into inlets 162, 164 may be plumbed from the turbine itself, represented by item number 166. The turbine 166 may include one, two, or more ports 168, 170 which are separate from the main turbine exit 172 through which the main flow passes. The ports 168, 170 may lead to the inlets 162, 164 through passages 174, 176 which may be tubular and bent as shown. Annular manifolds placed along the circumference of the outer wall and centerbody at the locations of injection, are used to collect and settle the relatively high pressure air and provide conditions for uniform blowing through inlets 162, 164. As discussed below in more detail, one or more annular slots or discrete holes placed circumferentially along the inner and outer walls may be used as turbine extraction ports 168, 170 and diffuser inlet blowing ports 162, 164. Due to the higher area ratio and lack of separated flow, the total pressure P0' and total temperature T0' in the diffuser 160 is less than the total pressure P0 and total temperature T0 of the nominal diffuser 120. Consequently, there is an increase in work extraction from the turbine 166.

Active blowing works for "poor" diffuser inlet flow conditions as the ones prevailing at the turbine exit of a typical gas turbine (FIG. 6, CAFD profile), and the blowing power can be adjusted to actual machine operating conditions. There is no performance degradation in time, and the active control system requires low maintenance. As described with respect to FIG. 11, the turbine air extraction option of active blowing requires mostly plumbing work for implementation.

Figure 12:
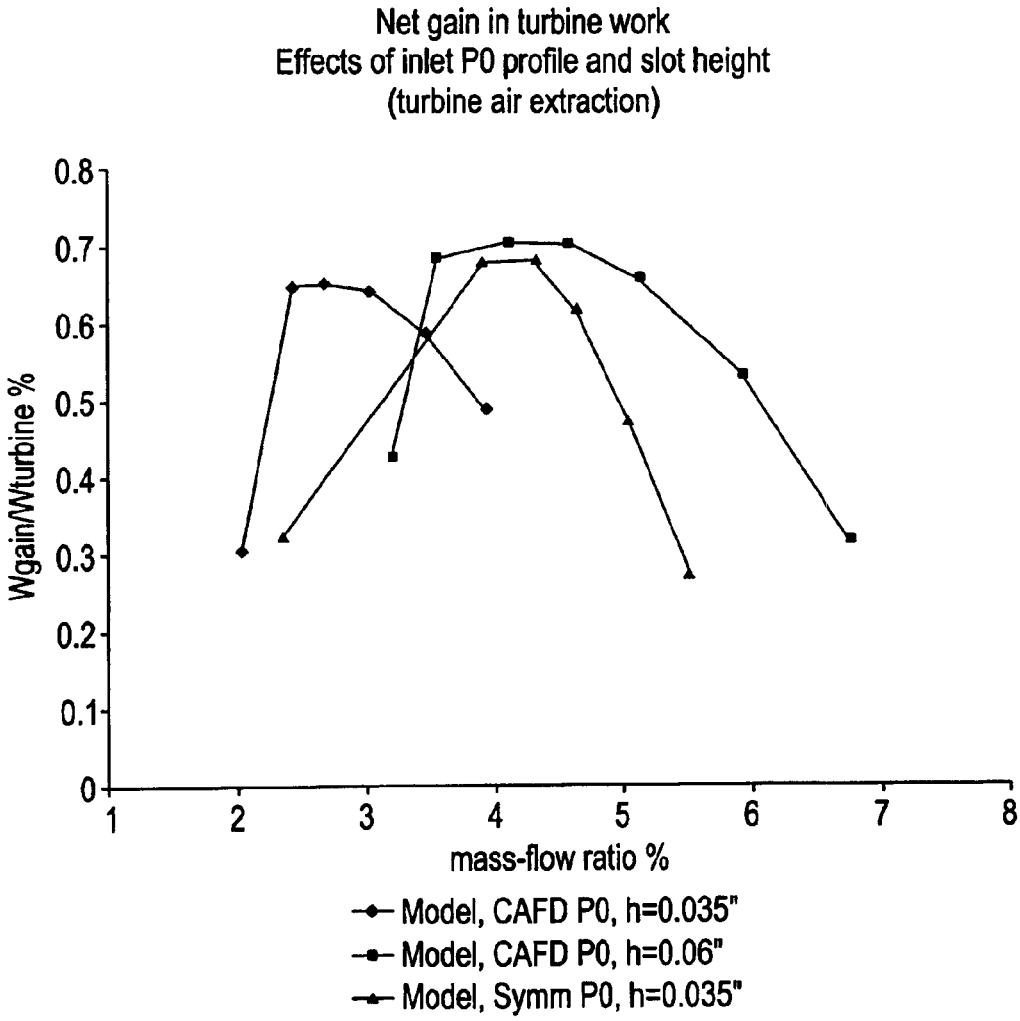
FIG. 12 shows a graph of Wgain/Wturbine % vs mass-flow ratio % for a diffuser augmented with fluidic actuation using turbine air extraction.

For determining an optimal scheme performance, that is, the maximum net gain in turbine work, the maxima in the plot of Wgain/Wturbine % versus mass-flow ratio % is located. For the turbine air extraction embodiment, such as shown in FIG. 11, an exemplary plot is shown in FIG. 12, where Wgain/Wturbine % is determined using the formulae shown in FIG. 13. Correspondingly, optimal mass-flow ratios of injections are identified. Within the formulae shown in FIG. 13, the followings values were used:

$$\left.\begin{array}{l}\text{Turbine total pressure ratio: } P0i/P0 = 10.7425\\ \text{Turbine thermodynamic (polytropic) efficiency: } et = 0.8996\\ \text{Gamma (turbine)} \cdot \gamma = 1.343\end{array}\right|$$

Of course, it should be understood that the values provided and the resultant plots are only an exemplary embodiment of one possible optimal scheme performance determination. As the value of any variable, such as slot height, P0, et, and gamma is altered, so will the resultant optimal scheme performance determination.

Figure 14:
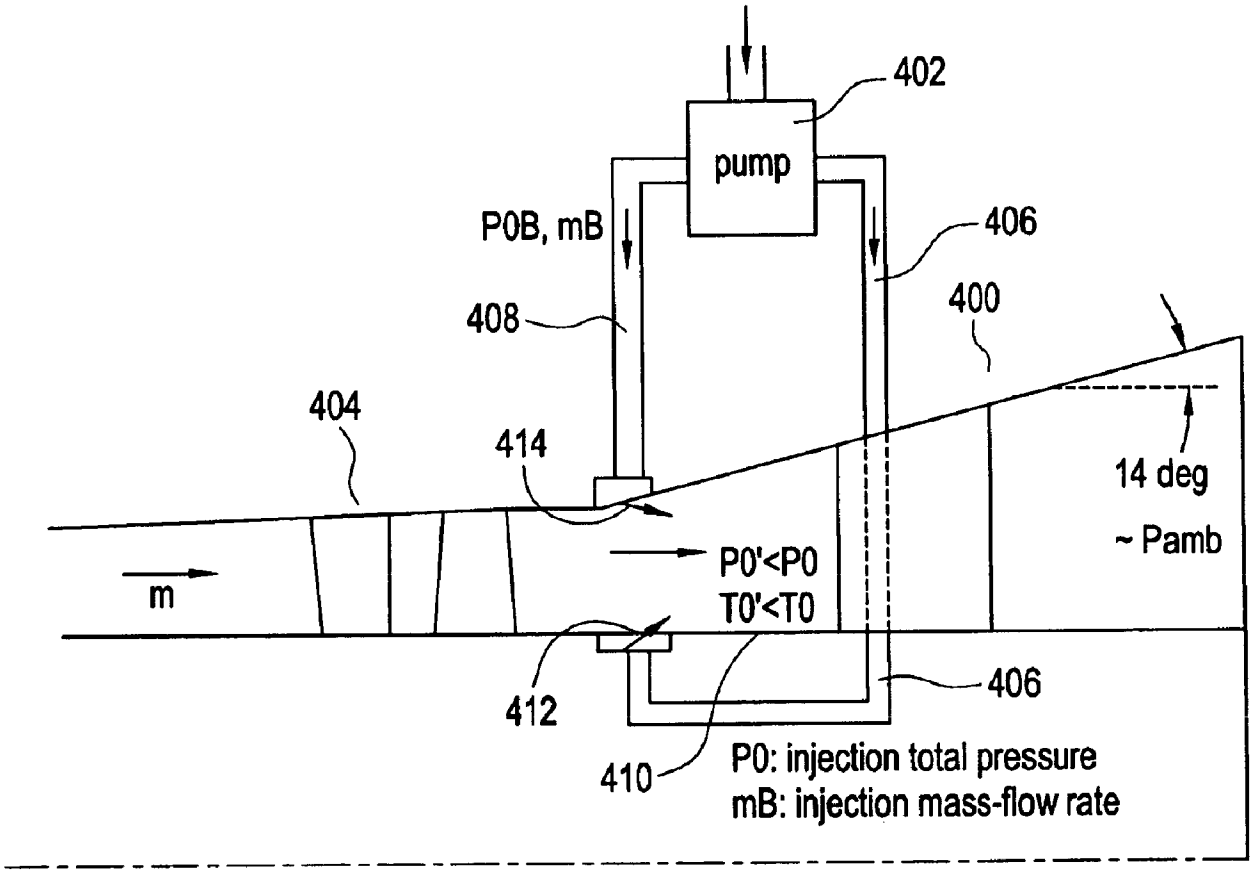
FIG. 14 shows a diagram of an exhaust annular diffuser augmented with fluidic actuation (inlet blowing) using an independent booster as blowing source.

FIG. 14 shows a diagram of an augmented 14 deg exhaust diffuser 400 provided with inlet blowing whereby the blowing source is an independent booster unit 402 (e.g. a pump) isolated from the gas turbine 404. This unit 402 can be placed adjacent to the exhaust diffuser 400 to minimize required plumbing work and flow losses through pipes 406, 408. As for injection along the centerbody wall 410, pipes 406 can be run from the location of the injection ports 412 through the diffuser struts and connected to the external booster output 402 as shown in FIG. 14.

Figure 15:
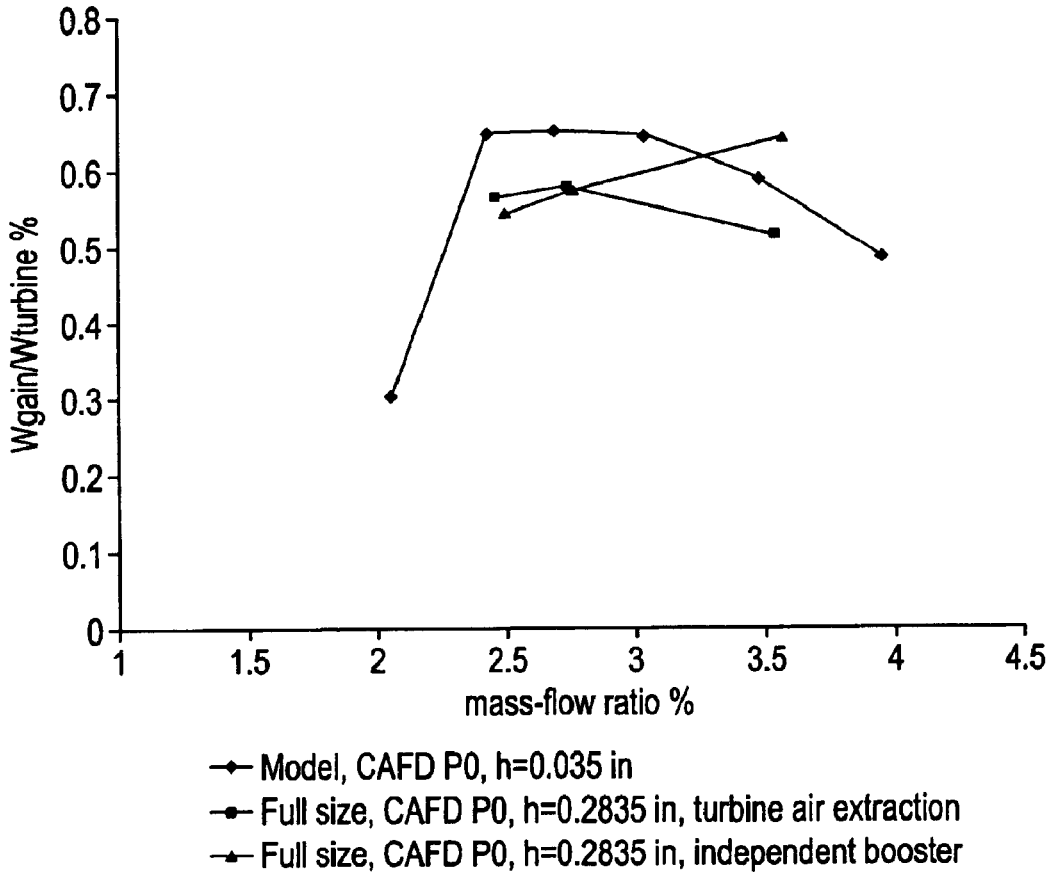
FIG. 15 shows a graph of Wgain/Wturbine % vs mass-flow ratio % for a diffuser augmented with fluidic actuation using an independent booster as blowing source.

Similar to FIG. 12, FIG. 15 shows the plot of Wgain/Wturbine % versus mass-flow ratio % where a performance comparison between the turbine air extraction embodiment and the independent booster unit embodiment is made. FIG. 16 shows the formulae for deriving Wgain/Wturbine % for the independent booster unit option where the turbine total pressure ratio remains the same as for FIG. 13 and the following values were used:

Gamma (booster)·γ'=1.4 and Booster unit polytropic efficiency: ec=0.85|

As shown in FIG. 15, there is approximately 0.65% maximum net gain in work extraction from the turbine using the independent booster unit as blowing source. As a result of improved exhaust system performance, there is an increased gas turbine output. The results of this particular study on the 7EA exhaust diffuser show that there can be approximately a 1% to 1.5% increase in work delivered at the generator shaft (0.5 point increase in simple cycle efficiency) by implementing the above described fluidic actuation scheme to the exhaust diffuser of the gas turbine.

The geometry of the injection ports, mode of injection (steady versus pulsating), and the selection of the blowing source with regards to the application of the inlet blowing technology to exhaust systems of ground based power gas turbines will now be described.

Two embodiments for the geometry of the injection ports are considered annular slots and discrete holes.

One or more annular slots at the diffuser inlet extending around a portion of the circumference of the outer wall and center-body provide one geometry embodiment.

The proposed height of the slot is h~0.015–0.02 W (where W is the height of the annular diffuser inlet passage such as in FIG. 10).

Figure 17:
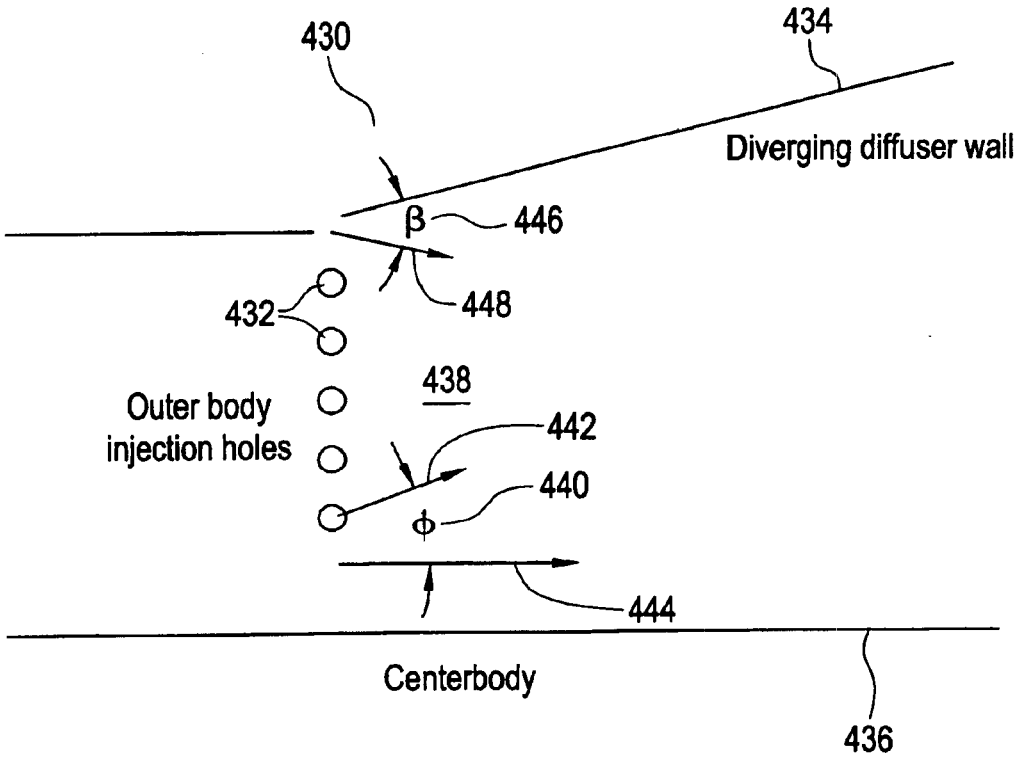
FIG. 17 shows a diagram of the angles used to define the direction of hole injection.

Discrete holes 432 discharging high momentum secondary jets from the outer wall 434 and center-body 436 into the wall boundary layer regions at the diffuser inlet 438 such as shown in the diffuser 430 in FIG. 17 is another geometry embodiment. The proposed diameter of the hole 432 ranges from 0.02 to 0.05 W. In order to achieve maximum effectiveness for a specific application, provision is made to control the angle 440 between the axis of the secondary jet 442 and the flow direction 444 (swirl angle ϕ440) and the angle 446 between the axis of the secondary jet 448 and the local diffuser wall 434 slope (β446). It should be noted that this embodiment includes the case of discrete holes discharging secondary jets tangent to the diverging diffuser walls in the direction of the axis of the diffuser and the case of secondary jets parallel to the main flow direction.

Figure 18:
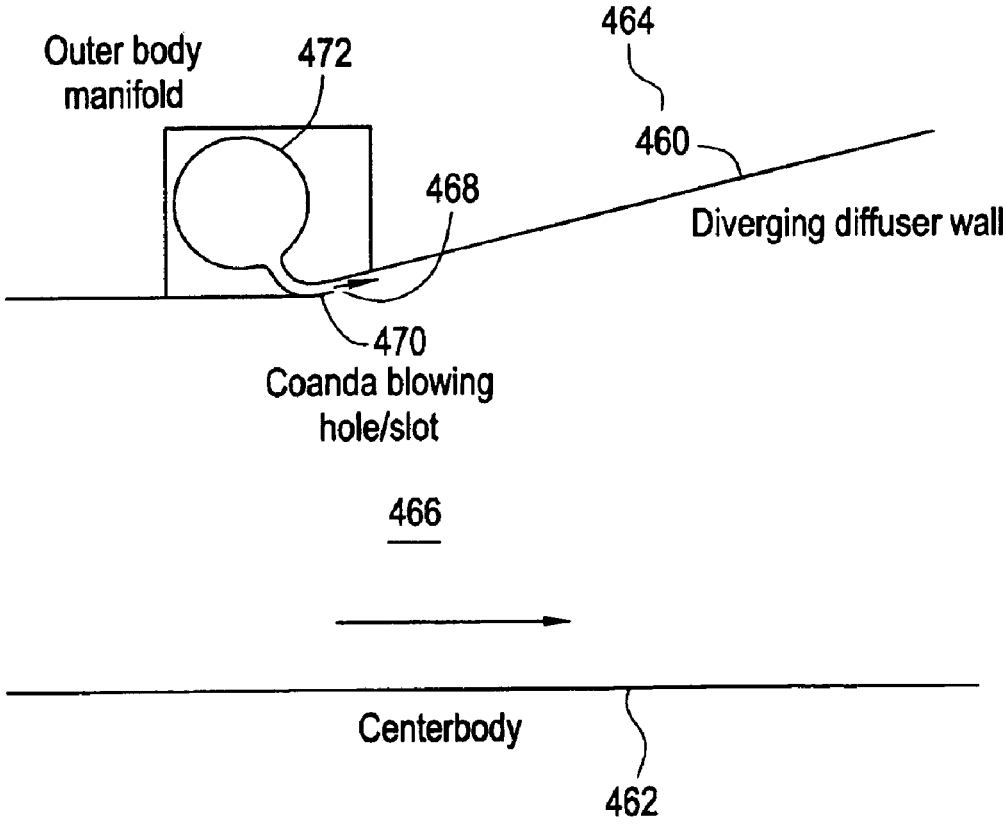
FIG. 18 shows a diagram of a Coanda blowing hole/slot.

For the case of slot/hole injection tangent to the diverging diffuser walls 460 of a diffuser 464, the Coanda effect as demonstrated in FIG. 18 can be used to keep the secondary jets/films attached to the walls 460. The Coanda effect was described by Henri Coanda, a Romanian scientist, in the 1930's. This effect describes the tendency of moving air or other fluids to follow the nearby curved or inclined surface. That is, the name Coanda effect is generally applied to any situation where a thin, high speed jet of fluid meets a solid surface and follows the surface around a curve. In this case, the exit direction 468 of the slot/hole passage 470 is a curve convex relative to the diffuser 464 main flow passage 466 for directing air from the outer body manifold 472.

Relative to slots, discrete holes have the advantage of easier implementation in a Gas Turbine exhaust system. From the blowing source, the blowing air can be collected into annular manifolds mounted around the circumference of the exhaust outer casing and in the centerbody. Subsequently, small circular tubes connected to the manifold can be used to inject secondary air jets into the main stream. The cross section of the manifold should be at least 15–20 times larger than the diameter of the holes to avoid injection with circumferential variation. Alternatively, small tubes can be used to carry the blowing air directly from the blowing source to the location of injection in the main stream.

A further advantage of discrete holes relative to circumferential slots is the fact that localized circular jets are expected to promote the development of three-dimensional disturbances in the boundary layer along the diffuser walls. This would enhance mixing and could in principle decrease the required mass-flow rate of secondary air therefore increasing the effectiveness of the blowing scheme.

It has been assumed so far that steady secondary flow is injected to prevent separation in a high included angle exhaust diffuser geometry. An alternate embodiment, which could substantially decrease the required amount of secondary air, is to inject pulsating films/jets in the diffuser wall boundary layers to prevent separation. Unsteady injection is expected to be more effective at delaying separation than steady one due to the artificial generation and development of coherent structures in the diffuser wall boundary layers which substantially enhance the mixing of the low momentum boundary layer flow with the high momentum core. Factors such as pulsing frequency, duty cycle and amplitude of the pulsations need to be considered if this embodiment is employed.

For transitioning the fluidic actuation scheme to a gas turbine, a blowing source to provide flow control at the exhaust diffuser inlet needs to be selected. Embodiments within the scope of this invention include extraction from upstream turbine stages such as from upstream the last turbine stage as shown in FIG. 11, extraction from upstream compressor stages, exploitation of the natural static pressure gradient between diffuser inlet and ambient conditions (the "no penalty option" as shown in FIG. 19), and an independent booster source unit as shown in FIG. 14.

Figure 19:
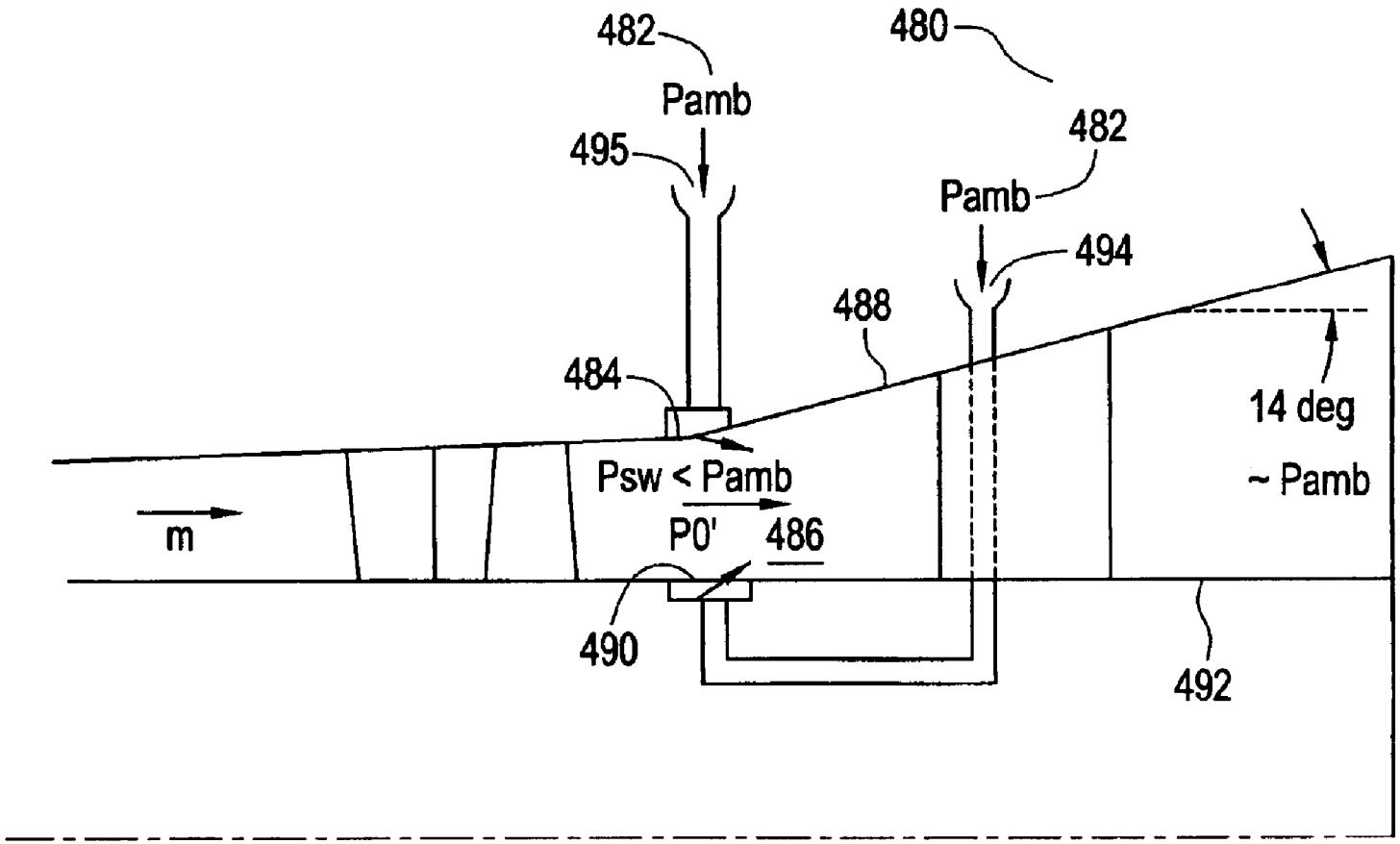
FIG. 19 shows a diagram of an exhaust annular diffuser augmented with fluidic actuation (inlet blowing) using ambient air as blowing source.

FIG. 19 shows a diffuser 480 which allows the entrance of air at ambient pressure 482 from port 495 into an opening 484 in the vicinity of the diffuser inlet 486 adjacent divergent wall 488 and into opening 490 adjacent centerbody wall 492 through port 494.

The proper selection of the blowing source depends on the specific application (simple cycle versus combined cycle machine, flow conditions at the diffuser inlet, total pressure ratio across the machine, machine geometrical configuration), easiness of implementation and the results of a system analysis which enables the identification of the optimal source in terms of a cost to benefit balance (scheme effectiveness).

Figure 20:
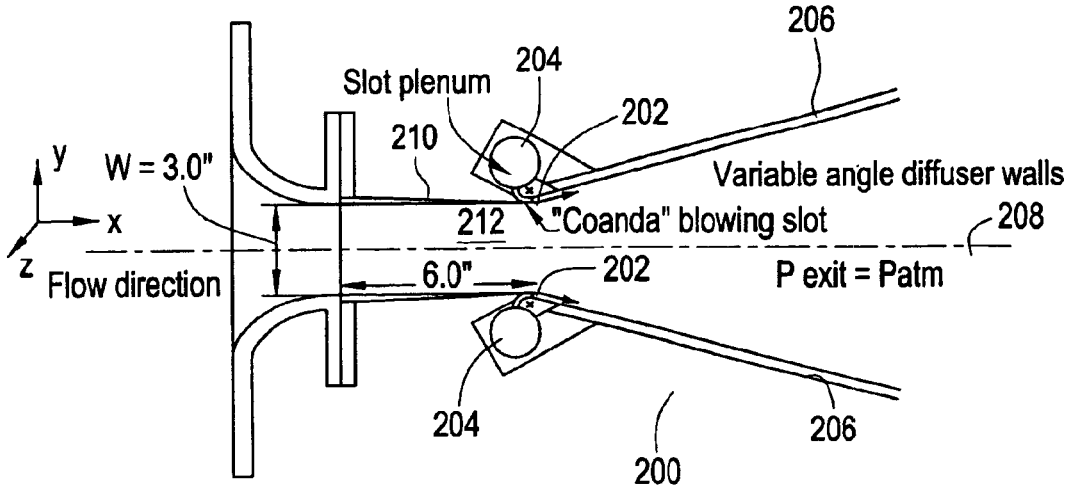
FIG. 20 shows a diagram of a wide-angle 2D diffuser model with inlet blowing.
Figure 21:
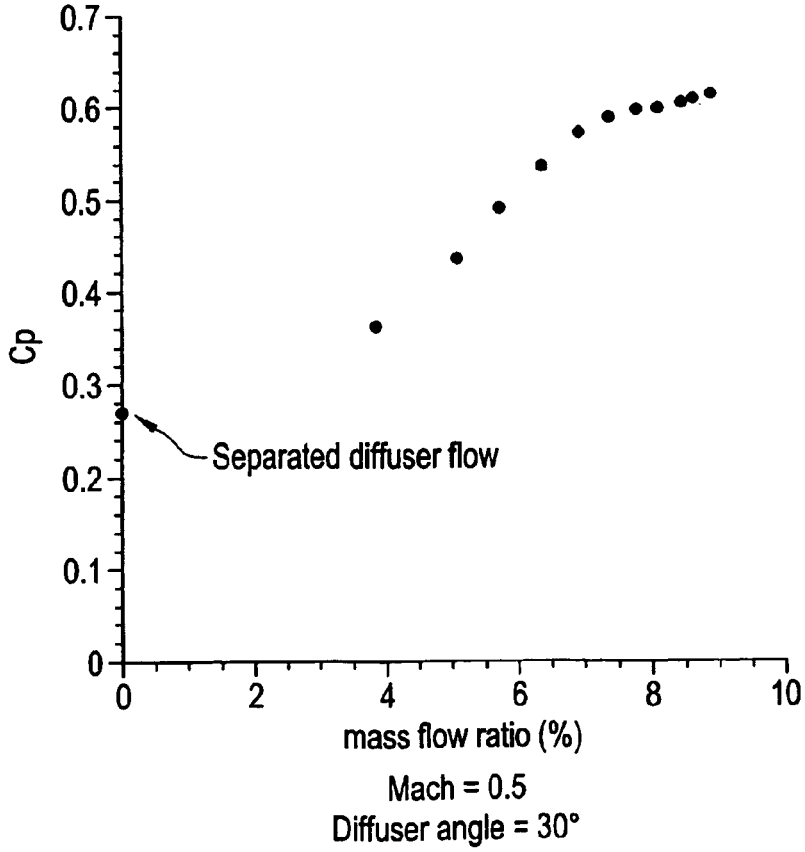
FIG. 21 shows a graph of measured Cp versus measured mass flow ratio for the diffuser model of FIG. 20.

A 2D straight wall diffuser model 200 is shown in FIG. 20. The slots 202 are arranged such that the blowing air from the manifold 204 is provided parallel to the diverging diffuser walls 206 ("Coanda" blowing slots as shown in FIG. 18), as opposed to parallel to the longitudinal axis or centerline 208. The plot for measured Cp versus measured mass flow ratio (%) is shown in FIG. 21, for the particular example where Mach=0.5 and Diffuser angle=15°. The results of these experiments show that the diffuser pressure recovery coefficient Cp can be increased by up to 100% by means of blowing at the diffuser inlet 212. For these initial experiments, blowing was provided only along the upper and lower diverging walls 206 but not on the straight side walls. In addition, the "uncontrolled" flow (no blowing) was found to separate at the inlet 212 and fully attach to either the lower or upper wall 206.

Figure 22:
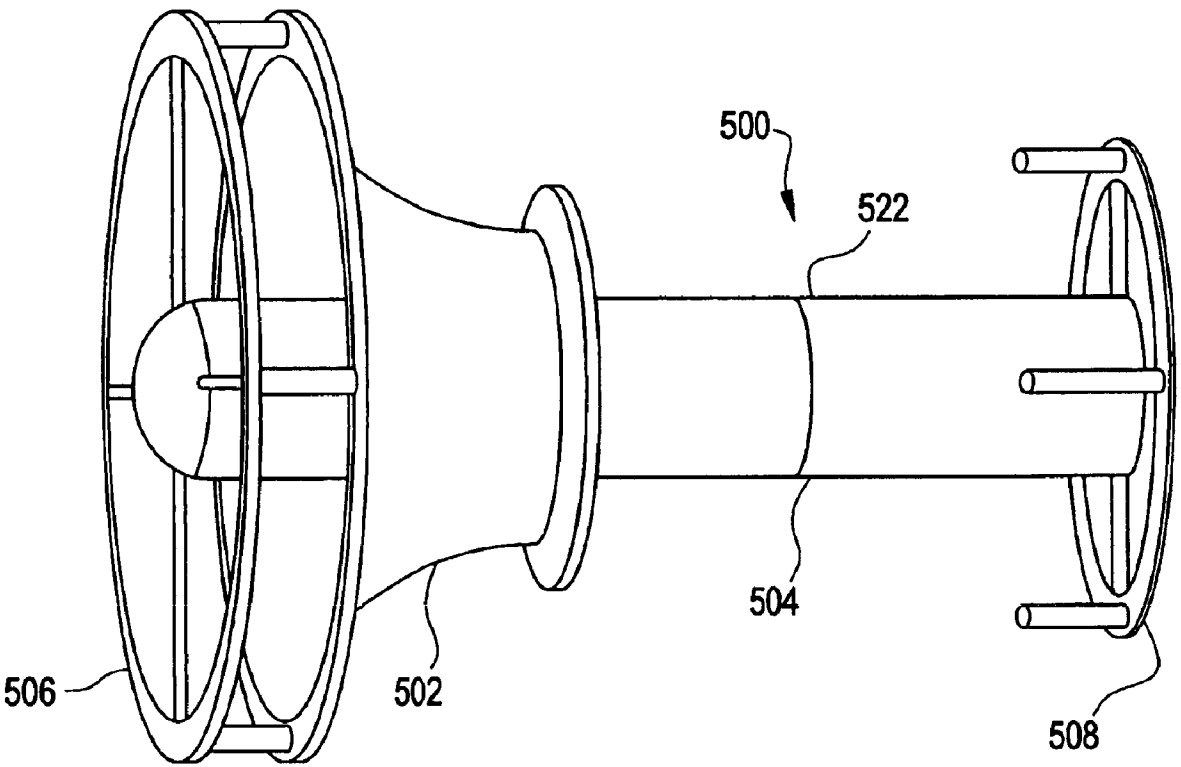
FIG. 22 shows a side view of a partial wide-angle (14 deg) annular diffuser model provided with inlet blowing.
Figure 23:
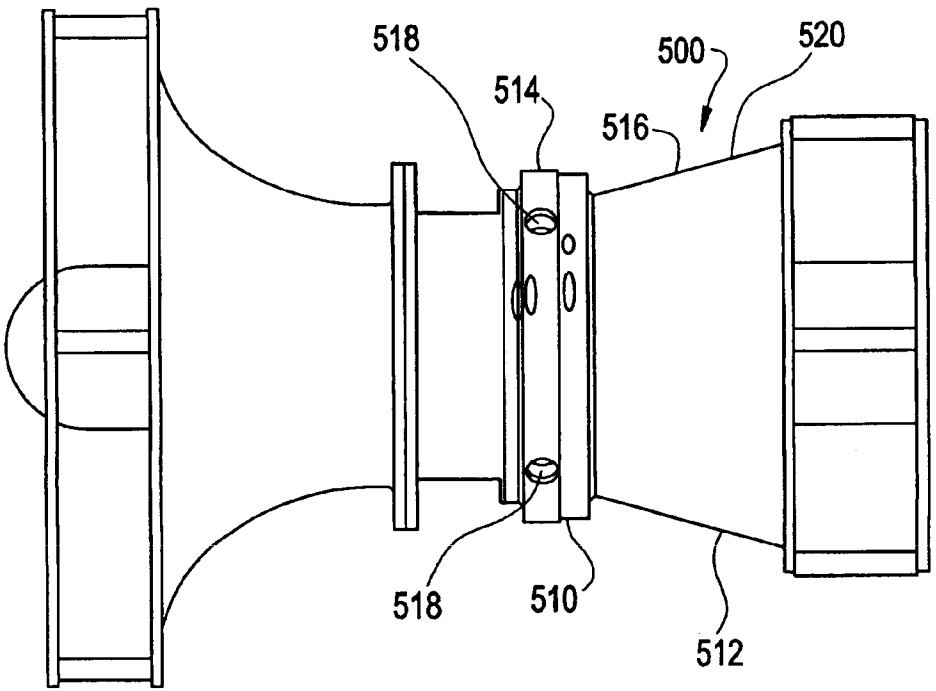
FIG. 23 shows a side view of a wide-angle (14 deg) diffuser model provided with inlet blowing.
Figure 24:
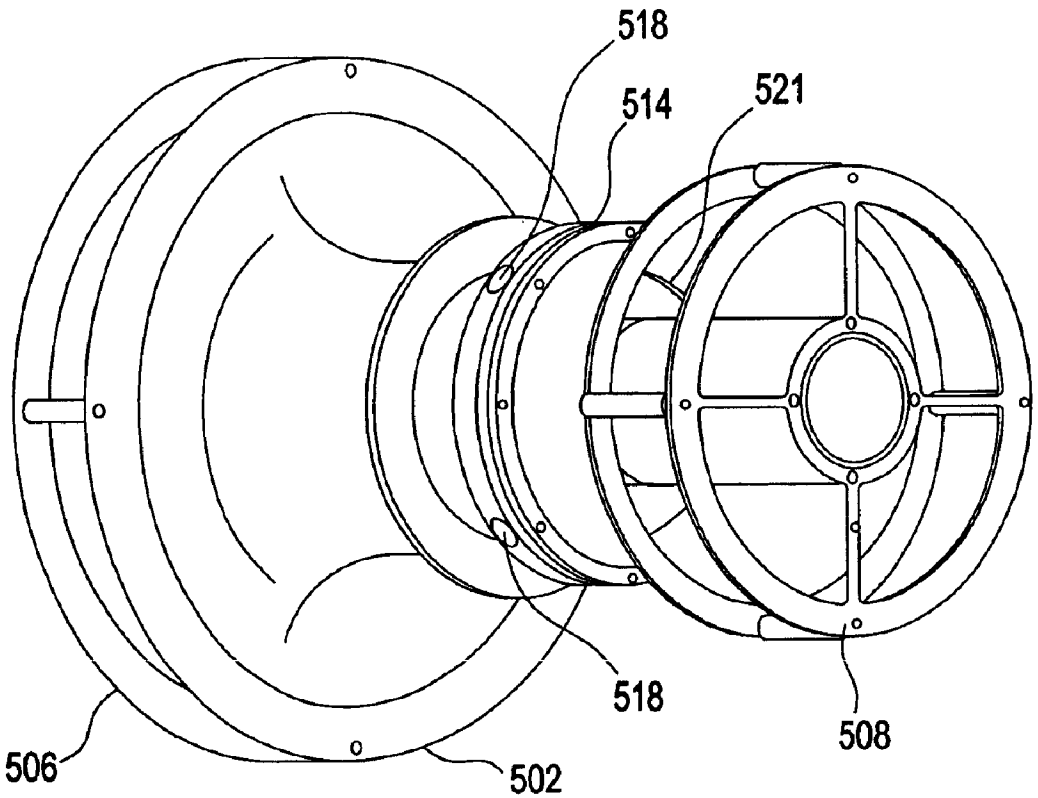
FIG. 24 shows a perspective view of a wide-angle (14 deg) diffuser model provided with inlet blowing.

An augmented annular diffuser model 500 geometry, such as the 7EA gas turbine, with provision for inlet blowing is shown in FIGS. 22–24. The model 500 is a 1:8.1 scale model of a full scale 7EA diffuser geometry. Unlike the full scale exhaust diffuser, the model 500 is not provided with supporting struts in the diverging section. Also, the angle of the diverging walls of the model is 14 deg as opposed to an angle of 8 deg for the nominal full scale geometry currently used in the 7EA machine.

In FIG. 22, the bellmouth 502 and the centerbody 504 of the annular diffuser model 500 are shown. The spiders 506, 508 at both ends of the model 500 are used to support the centerbody 504 relative to the outerbody 516 of the model 500. FIGS. 23 and 24 show a diagram of the complete model 500. The inner radius is 3.6" and the outer radius at the inlet section 510 is 5.56". The length of the diverging section 512 of the model 500 is approximately 10". An annular manifold 514 placed around the circumference of the outer body 516 and provided with four pipe inlets 518 is used to collect high pressure air supplied by two large volume high pressure tanks, although an alternate number of pipe inlets would be within the scope of this system. The high pressure air is injected uniformly into the main diffuser flow, parallel to the diverging walls 520, through a 30 mils wide annular slot 521 located at the inlet section 510 of the diffuser 500 around the circumference of the outer body 516 (FIGS. 23–24). An additional annular slot 522 shown in FIG. 22, located approximately 2.5" downstream from the inlet section 510 around the circumference of the centerbody 504, is used for injection to prevent boundary layer separation from the centerbody 504.

Figure 25:
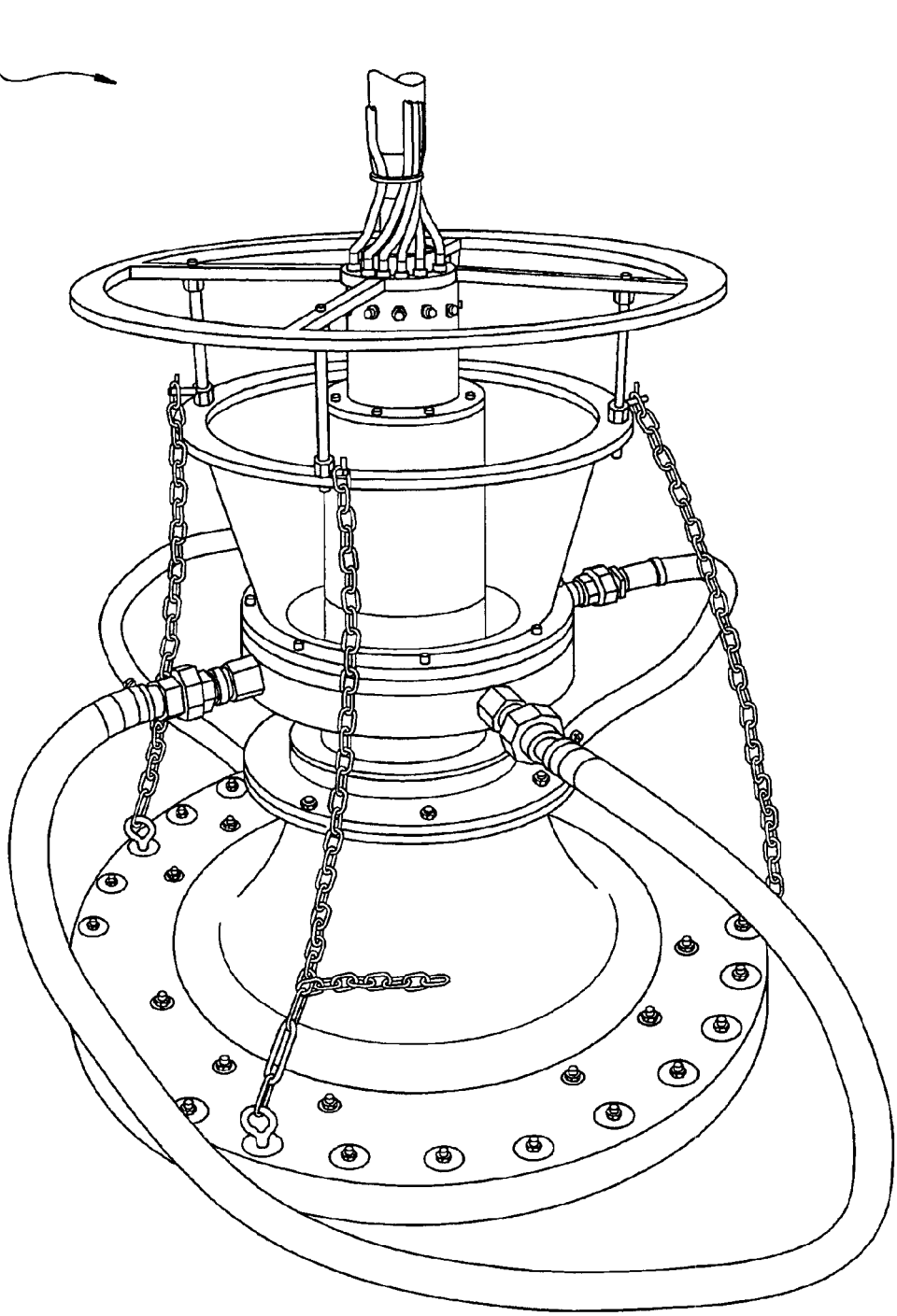
FIG. 25 shows a rig with the diffuser model of FIGS. 22–24.
Figure 26:
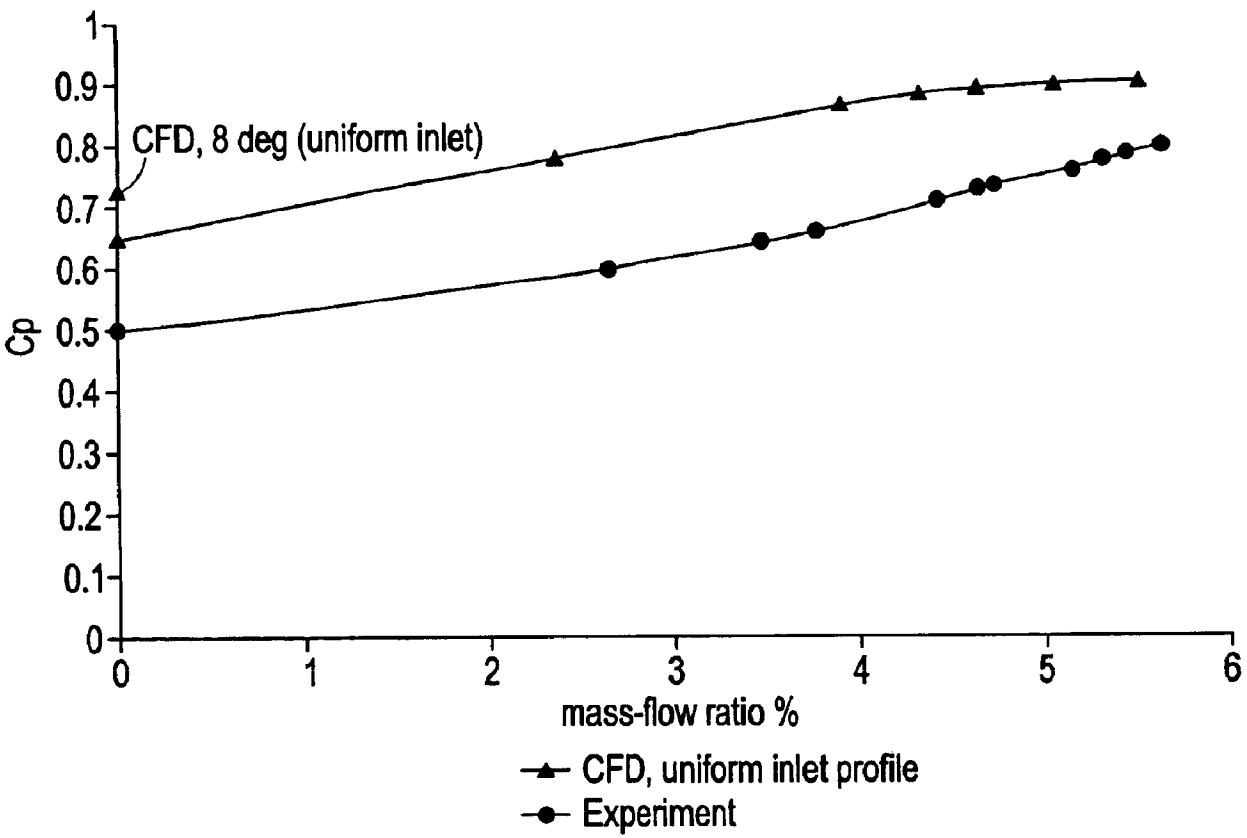
FIG. 26 shows a graph comparing the results of experiments and computer simulations.

FIG. 25 shows an experimental rig 540, which shows the manifold 514 with four hoses blowing air into the manifold 514 through the four inlet holes, two of which are shown in FIGS. 23 and 24. Tests confirm the effectiveness of inlet blowing in preventing boundary layer separation and producing a high pressure recovery through the diffuser. FIG. 26 shows a comparison between results from experiments and CFD simulations. The relative increase in pressure recovery (Cp) with mass-flow ratio is well predicted by CFD. With no inlet blowing (zero mass-flow ratio), the boundary layer separates in the vicinity of the inlet section from the outer wall and consequently a low value of the coefficient of pressure recovery of 0.5 is measured. The quantitative offset between the two curves in FIG. 26 is the result of differences in inlet flow distributions between experiments and simulations which as described above (FIG. 7) affect the performance of the diffuser.

While specific dimensions were used for the model 500, it should be understood that the dimensions are exemplary only, and that the dimensions may be changed accordingly for size, location, and application of a particular diffuser and thus should not be construed as limiting. In particular, while an 8 degree diffuser is described above as augmented to a 14 degree diffuser, it should be understood that other diffusers with divergent wall angles other than 8 degrees may be augmented as described, and that such augmentation may include wall angles other than 14 degrees.

The above described fluidic actuation scheme as applied to gas turbines is also applicable to power generation steam turbine exhaust systems. Aggressive steam turbine exhaust systems with high potential pressure recovery (high area-ratio, short axial length) can be designed via the implementation of flow control (blowing/suction) to prevent wall boundary layer separation. This embodiment addresses blowing/suction source and geometry of blowing/suction ports, which are important for the practical implementation of the flow control technology to steam turbine axial flow diffusers and down flow exhaust hoods. While the basic technology is the same as that described earlier in detail and as applied to gas turbines, mainly differences in the details concerning the actual implementation of the technology to the steam turbine exhaust system will be noted.

Figure 27:
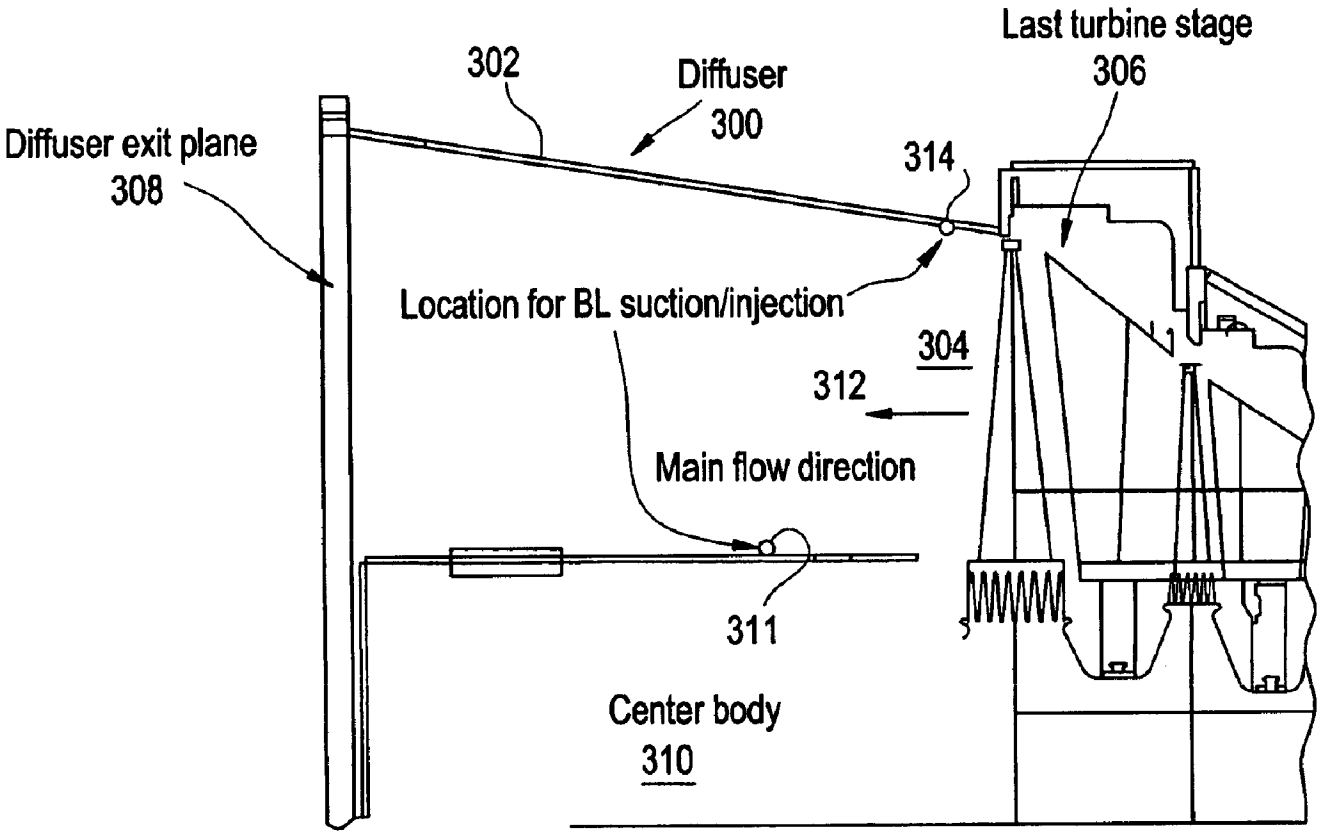
FIG. 27 shows a sketch of a steam turbine axial flow diffuser augmented with fluidic actuation; and, FIG. 28 shows a sketch of a steam turbine down-flow exhaust hood augmented with fluidic actuation.
Figure 28:
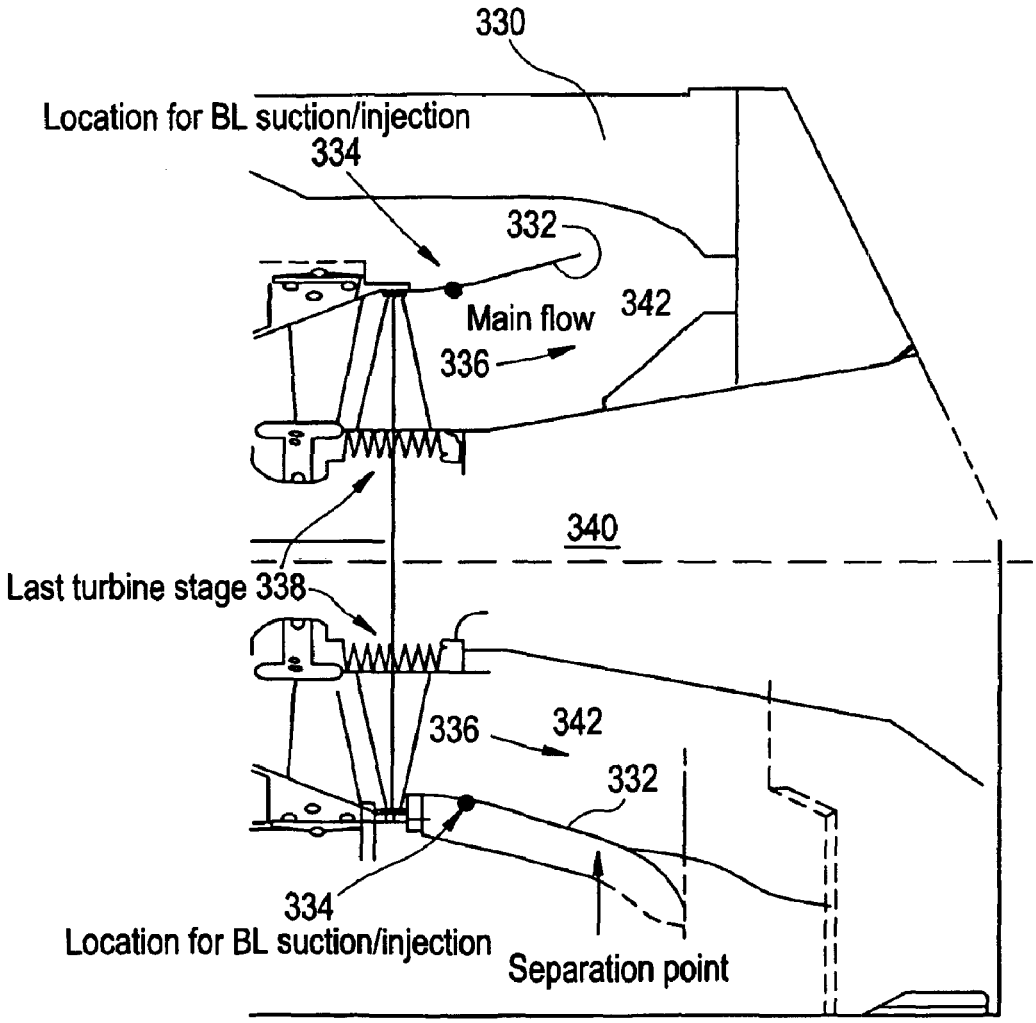

An axial flow diffuser as shown in FIG. 27 and a down-flow exhaust hood as shown in FIG. 28 are two types of steam turbine exhaust systems addressed. For both exhaust systems, the implementation of the wall blowing/suction technology has the potential of enabling a design which yields high pressure recoveries (low energy losses) within the geometrical constraints of the exhaust configuration. As a result, increased work extraction from the machine can be achieved.

An example of an augmented steam turbine axial flow diffuser 300 is shown in FIG. 27. The annular diffuser 300 includes a centerbody 310 and a diverging diffuser wall 302 extending from a diffuser inlet section 304, which is adjacent the last turbine stage 306, to the diffuser exit plane 308. The main flow 312, indicated by the flow direction arrow, flows from the last turbine stage 306, through the diffuser 300, and past the diffuser exit plane 308. Spots 314 and 311 indicate approximate locations of the boundary layer injection/suction ports. It should be noted that there are injection ports 311, 314 along the outer diverging diffuser wall 302 and the straight centerbody 310. The injection/suction ports should be located just upstream the point where boundary layer separation occurs. Also, injection port 311 provided on centerbody 310 is downstream injection port 314 provided on diffuser wall 302.

For the down-flow exhaust hood case shown in FIG. 28, there is very low pressure recovery for the current geometry: for typical machine operating conditions Cp is about 0.3 which is indicative of substantial energy losses through the duct, however the geometry constraints and flow separation prevent increase in performance. Flow control (blowing/suction) enables the design and implementation of a more aggressive-higher area ratio-exhaust hood geometry with a potentially higher pressure recovery while preventing boundary layer separation and associated losses. Since most of the diffusion in a down-flow exhaust hood 330 occurs through the steam guide passage 332 (FIG. 28), a higher area ratio steam guide passage has the potential to yield a higher pressure recovery as long as flow separation is prevented. Blowing/suction is applied at location 334 around the circumference of the steam guide 332 near the hood inlet 336, which is adjacent the last turbine stage 338, to energize/remove the boundary layer and prevent flow separation of the main flow 342. Because of the conical shape of the centerbody 340, injection along the wall of the center cone is typically not required.

For the axial flow diffuser, such as shown in FIG. 27, annular slots or discrete holes may be employed for the geometry of the injection ports similarly to the case of the annular exhaust diffuser of a gas turbine discussed above.

One or more annular slots extending around a portion of the circumference of the outer wall 302 and center-body 310 are placed in the vicinity of the diffuser inlet 304. The proposed height of the slot is h~0.015–0.02 W (where W is the height of the annular diffuser inlet passage).

Discrete holes discharging high momentum secondary jets from the outer wall 302 and center-body 310 into the wall boundary layers of the main stream 312 at the diffuser inlet 304. The proposed diameter of the hole ranges from 0.02 to 0.05 W. In order to achieve maximum effectiveness for a specific application, provision is made to control the angle between the axis of the secondary jet and the main flow direction and the angle between the axis of the secondary jet and the local diffuser wall slope (see FIG. 17). It should be noted that this embodiment includes the case of discrete holes discharging secondary jets tangent to the diverging diffuser walls in the direction of the axis of the diffuser and the case of secondary jets parallel to the main flow direction.

For the down-flow exhaust hood, such as shown in FIG. 28, annular slots or discrete holes may be used.

Annular slots placed in the vicinity of the hood inlet 336 and extending around a portion of the circumference of the steam guide 332 may be employed. The proposed height of the slot is h~0.015–0.02 W (where W is the height of the annular hood inlet passage 336).

Discrete holes discharging high momentum secondary jets from the steam guide 332 into the wall boundary layers of the main stream 342 in the vicinity of the hood inlet 336 may also be employed. The proposed diameter of the hole ranges from 0.02 to 0.05 W. In order to achieve maximum effectiveness for a specific application, provision is made to control the angle between the axis of the secondary jet and the flow direction and the angle between the axis of the secondary jet and the local steam guide slope. It should be noted that this embodiment includes the case of discrete holes discharging secondary jets tangent to the steam guide walls in the direction of the axis of the hood and the case of secondary jets parallel to the main flow direction.

For the case of injection tangent to the exhaust diffuser/hood walls, the Coanda effect can be used to keep the secondary jets/films attached to the walls, as previously described with respect to gas turbine exhaust diffusers such as shown in FIG. 18.

Relative to the slots, the discrete holes have the advantage of easier implementation in a steam turbine exhaust system. From the blowing source, the blowing fluid can be collected into an annular manifold mounted around the circumference of the exhaust outer casing. Small circular tubes connected to the manifold can be used to inject secondary jets into the main stream. The cross section of the manifold should be at least 15–20 times larger than the diameter of the holes to avoid injection with circumferential variation. Alternatively, small tubes can be used to carry the secondary flow directly from the blowing source to the location of injection in the main stream.

A further advantage of discrete holes relative to circumferential slots is the fact that localized circular jets are expected to promote the development of three-dimensional disturbances in the boundary layer along the diffuser walls. This would enhance mixing and could in principle decrease the required secondary mass-flow rate therefore increasing the effectiveness of the blowing scheme.

It has been suggested so far that steady secondary flow is injected/sucked to prevent separation in a high area ratio exhaust geometry. An alternative embodiment, which could substantially decrease the required amount of secondary flow, is to inject pulsating films/jets. Unsteady injection is expected to be more effective at delaying separation than steady injection due to the artificial generation and development of coherent structures in the wall boundary layers which substantially enhance the mixing of the low momentum boundary layer flow with the high momentum core. Parameters which will play a role in the effectiveness of pulsating films/jets include pulsing frequency, duty cycle and amplitude of the pulsations.

To transition the fluidic actuation scheme to a steam turbine machine, the selection of a blowing/suction source to provide flow control at the exhaust inlet should be addressed. Embodiments within the scope of this fluidic actuation scheme include steam extraction from upstream turbine stages such as from upstream the last turbine stage (blowing), independent booster/vacuum source unit (blowing/suction), and steam extraction from the exhaust exit (high pressure) and re-injection at the inlet (low pressure) through a closed loop circuit. For the last option, if needed, the total pressure of the exhaust exit flow could be increased prior to injection through the use of a steam ejector driven by a small amount of steam extracted from upstream turbine stages (blowing).

When employing suction in a condensing steam turbine, the lower pressure flow sink could be achieved by employing an additional 'suction condenser' supplied with cooling water at a lower temperature than that of the main condenser. This lower temperature cooling water could potentially be the same cooling water used to supply the main condenser but passed through the suction condenser first when its temperature is the lowest before being sent to the main condenser. At the pressures typical of a condensing steam turbine, 1.5 inHgabs (inches of mercury absolute) a pressure ratio of 1.2 between the main flow and the suction condenser can be achieved with a temperature difference of less than 10 degrees F. (suction).

The proper selection of the blowing source depends on the specific application (machine configuration, flow conditions at the exhaust inlet, total pressure ratio across the machine), ease of implementation, and the results of a system analysis which enables the identification of the optimal source in terms of a cost to benefit balance (scheme effectiveness).

For a steam turbine such as single flow 100 MW M/C A10, the augmented axial flow diffuser with inlet blowing/suction has the potential to increase the steam turbine output by up to 400 KW (or 0.4%). The estimate corresponds to an increase of the value of the pressure recovery coefficient Cp from 0.25–0.3 to 0.6.

Thus this invention provides application of blowing/suction to exhaust systems of gas turbines and steam turbines, injection/suction port geometry and details of implementation, mode of injection/suction (steady versus pulsating) in the context of the specific application pursued, and various proposed blowing/suction sources.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A diffuser augmented with fluidic actuation, the diffuser comprising:

a longitudinal axis;

a diffuser inlet having a width W;

a diverging section having a diffuser wall;

an opening in the diffuser wall adjacent the diffuser inlet; and, a curved passageway adjacent the opening, wherein the curved passageway is curved convexly relative to the longitudinal axis, the curved passageway for introducing a secondary jet into the opening and along the diffuser wall for maintaining the secondary jet along the wall using the Coanda effect, wherein an independent booster unit is connected to the curved passageway.

2. The diffuser of claim 1 comprising a plurality of openings distributed about a circumference of the diffuser wall.

3. The diffuser of claim 2 wherein the plurality of openings are evenly distributed.

4. The diffuser of claim 1 wherein fluid is further injected into the diffuser through an opening in a centerbody positioned within the diffuser.

5. The diffuser of claim 1 wherein the opening is a circular opening having a diameter between 0.02W and 0.05W.

6. The diffuser of claim 1 wherein the opening is an annular slot having a height between 0.015W and 0.02W.

7. The A diffuser augmented with fluidic actuation, the diffuser comprising:

a longitudinal axis;

a diffuser inlet having a width W;

a diverging section having a diffuser wall;

an opening in the diffuser wall adjacent the diffuser inlet;

a curved passageway adjacent the opening, wherein the curved passageway is curved convexly relative to the longitudinal axis, the curved passageway for introducing a secondary jet into the opening and along the diffuser wall for maintaining the secondary jet along the wall using the Coanda effect;

a plurality of openings distributed about a circumference of the diffuser wall; and an annular manifold mounted around a circumference of an outer casing of the diffuser, the annular manifold collecting fluid from an outside source and distributing the fluid to the openings.

8. The diffuser of claim 7 wherein fluid exiting the diffuser is transferred to the annular manifold.

9. The diffuser of claim 7 wherein fluid from an independent booster unit is directed to the annular manifold.

10. A diffuser augmented with fluidic actuation, the diffuser comprising:

a longitudinal axis;

a diffuser inlet having a width W;

a diverging section having a diffuser wall;

an opening in the diffuser wall adjacent the diffuser inlet;

a curved passageway adjacent the opening wherein the curved passageway is curved convexly relative to the longitudinal axis, the curved passageway for introducing a secondary jet into the opening and along the diffuser wall for maintaining the secondary jet along the wall using the Coanda effect; and an airway directing air from an upstream turbine into the curved passageway.

11. A gas turbine having a diffuser augmented with fluidic actuation, the gas turbine and diffuser comprising:

a diffuser inlet through which passes a main flow of air in a main flow direction;

a diverging section having a diffuser wall;

a centerbody placed within the diverging section;

at least one opening in the diffuser wall adjacent the diffuser inlet;

at least one opening in a wall of the centerbody in a vicinity of the diffuser inlet; and an independent booster unit providing a secondary flow of fluid through the at least one opening in the diffuser wall, wherein the independent booster unit feeds air into an annular manifold surrounding the diffuser inlet, wherein the annular manifold distributes the air from the independent booster unit into the at least one opening.

12. The gas turbine of claim 11, wherein passages are provided from the independent booster unit to each of the at least one opening.

13. The gas turbine of claim 11, wherein a diameter of the annular manifold is at least 15 times greater than a diameter of each of the at least one opening.

14. The gas turbine of claim 11 wherein each opening in the diffuser wall allows a secondary flow to pass, wherein each secondary flow is injected through an opening in the diffuser wall at a first controlled angle relative to the diffuser wall and at a second controlled angle relative to the main flow, wherein the first and second controlled angles are adjusted to maximize effectiveness.

15. The gas turbine of claim 11 wherein the diffuser inlet has a width W and each opening in the diffuser wall is circular and has a diameter between 0.02W and 0.05W.

16. The gas turbine of claim 11 wherein the diffuser inlet has a width W and each opening in the centerbody is an annular slot having a height between 0.015W and 0.02W.

17. A gas turbine having a diffuser augmented with fluidic actuation, the gas turbine and diffuser comprising:

a diffuser inlet through which passes a main flow of air in a main flow direction;

a diverging section having a diffuser wall;

a centerbody placed within the diverging section;

at least one opening in the diffuser wall adjacent the diffuser inlet;

at least one opening in a wall of the centerbody in a vicinity of the diffuser inlet; and a curved passageway adjoining each opening in the diffuser wall, wherein the curved passageway is curved convexly relative to the main flow direction.

18. A gas turbine having a diffuser augmented with fluidic actuation, the diffuser comprising:

a diffuser inlet placed adjacent the turbine;

a diverging section having a diffuser wall;

a plurality of openings in the diffuser wall;

an exit port in the turbine, the exit port separate from a main turbine exit;

a plurality of airways extending from the exit port to the opening, wherein air is extracted from the turbine and introduced into the diverging; and, a plurality of ports in the turbine and an annular manifold collecting air from the ports via the airways for distributing to the openings.

19. The gas turbine of claim 18 wherein the airway extends from a final turbine stage.

20. The gas turbine of claim 18 further comprising a curved passageway between the manifold and each of the openings, wherein the curved passageway is curved convexly relative to a longitudinal axis of the diverging section.

21. The gas turbine of claim 18 wherein the airway is a tubular structure.

22. A gas turbine having a diffuser augmented with fluidic actuation, the diffuser comprising:

a diffuser inlet placed adjacent the turbine;

a diverging section having a diffuser wall;

an opening in the diffuser wall;

an exit port in the turbine, the exit port separate from a main turbine exit;

an airway extending from the exit port to the opening, wherein air is extracted from the turbine and introduced into the diverging section;

a plurality of airways extending from the turbine, and a plurality of openings in the diffuser wall; and an annular manifold surrounding the diffuser inlet and the openings, the manifold collecting air from the airways and distributing the air to the openings.

23. A steam turbine comprising:

a final turbine stage;

an axial flow diffuser receiving a main flow from the final turbine stage;

a diverging wall in the axial flow diffuser, the diverging wall extending from a diffuser inlet to a diffuser exit;

a centerbody in the axial flow diffuser, an opening in the diverging wall and an opening in the centerbody for fluidically actuating the main flow, wherein the openings are located downstream from the diffuser inlet and upstream from a point where boundary layer separation would occur along the walls in a diffuser without the openings; and a suction source positioned adjacent the diffuser for sucking steam from the axial flow diffuser.

24. The steam turbine of claim 23 further comprising an independent booster unit positioned adjacent the diffuser for injecting a secondary flow into the axial flow diffuser.

25. The steam turbine of claim 23 further comprising a suction condenser supplied with cooling water at a lower temperature than cooling water of a main condenser of the steam turbine.

26. The steam turbine of claim 25 wherein the lower temperature cooling water is the same cooling water used to supply the main condenser, and wherein the cooling water passes through the suction condenser prior to being sent to the main condenser.

27. The steam turbine of claim 25 wherein a temperature difference between the cooling water supplied to the suction condenser and the cooling water supplied to the main condenser is less than approximately 10° F.

28. The steam turbine of claim 23 wherein the diffuser inlet has a width W and the opening in the diverging wall is circular and has a diameter between 0.02W and 0.05W.

29. The steam turbine of claim 23 wherein the diffuser inlet has a width W and the opening in the centerbody is an annular slot having a height between 0.015W and 0.02W.

30. The steam turbine of claim 23 wherein steam is extracted from an upstream turbine stage for injection into the opening in the diverging wall.

31. A steam turbine comprising a final turbine stage;

an axial flow diffuser receiving a main flow from the final turbine stage;

a diverging wall in the axial flow diffuser, the diverging wall extending from a diffuser inlet to a diffuser exit;

a centerbody in the axial flow diffuser;

an opening in the diverging wall and an opening in the centerbody for fluidically actuating the main flow, wherein the openings are located downstream from the diffuser inlet and upstream from a point where boundary layer separation would occur along the walls in a diffuser without the openings;

a plurality of openings in the diverging wall, each opening located equidistantly from the diffuser inlet; and an annular manifold surrounding the plurality of openings in the diverging wall, the annular manifold collecting fluid from an outside source for distributing to the openings.

32. The steam turbine of claim 31 further comprising tubes connecting the annular manifold to the openings.

33. The steam turbine of claim 32 wherein the tubes are curved convexly relative to the main flow.

34. The steam turbine of claim 31 wherein the annular manifold is at least 15 times greater in diameter than a diameter of each opening in the diverging wall.

35. A steam turbine comprising:

a final turbine stage;

an axial flow diffuser receiving a main flow from the final turbine stage;

a diverging wall in the axial flow diffuser, the diverging wall extending from a diffuser inlet to a diffuser exit;

a centerbody in the axial flow diffuser; and an opening in the diverging wall and an opening in the centerbody for fluidically actuating the main flow, wherein the openings are located downstream from the diffuser inlet and upstream from a point where boundary layer separation would occur along the walls in a diffuser without the openings, wherein steam is extracted from the diffuser exit and reinjected into the opening in the diverging wall.

36. The steam turbine of claim 35 wherein steam is extracted from an upstream turbine stage and added to the steam extracted from the diffuser exit for increasing the total pressure of the injected fluid.

37. A steam turbine comprising:

a final turbine stage;

a down-flow exhaust hood;

a centercone in the down-flow exhaust hood;

a steam guide passage in the down-flow exhaust hood receiving a main flow of air from the final turbine stage;

an opening in the steam guide for fluidically actuating the main, flow, wherein the opening is located downstream from the steam guide inlet and upstream from a point where boundary layer separation would occur along a steam guide without the opening; and an independent booster unit positioned adjacent the exhaust hood for injecting fluid into the down-flow exhaust hood.

38. The steam turbine of claim 37 wherein the exhaust hood inlet has a width W and the opening is circular and has a diameter between 0.02W and 0.05W.

39. The steam turbine of claim 37 wherein the exhaust hood inlet has a width W and the opening is an annular slot having a height between 0.015W and 0.02W.

40. The steam turbine of claim 37 wherein steam is extracted from an upstream turbine stage for injection into the opening.

41. The steam turbine of claim 37 wherein steam is extracted from the exhaust hood exit and reinjected into the opening.

42. The steam turbine of claim 41 wherein steam is extracted from an upstream turbine stage and added to the steam extracted from the exhaust hood exit for increasing the total pressure of the injected fluid.

43. A steam turbine comprising:

a final turbine stage;

a down-flow exhaust hood;

a centercone in the down-flow exhaust hood;

a steam guide passage in the down-flow exhaust hood receiving a main flow of air from the final turbine stage;

an opening in the steam guide for fluidically actuating the main flow, wherein the opening is located downstream from the steam guide inlet and upstream from a point where boundary layer separation would occur along a steam guide without the opening; and a suction source positioned adjacent the exhaust hood for sucking steam from the down-flow exhaust hood.

44. The steam turbine of claim 43 further comprising a suction condenser supplied with cooling water at a lower temperature than cooling water of a main condenser of the steam turbine.

45. The steam turbine of claim 44 wherein the lower temperature cooling water is the same cooling water used to supply the main condenser, and wherein the cooling water passes through the suction condenser prior to being sent to the main condenser.

46. The steam turbine of claim 44 wherein a temperature difference between the cooling water supplied to the suction condenser and the cooling water supplied to the main condenser is less than approximately 10° F.

47. The A steam turbine comprising:

a final turbine stage;

a down-flow exhaust hood;

a centercone in the down-flow exhaust hood;

a steam guide passage in the down-flow exhaust hood receiving a main flow of air from the final turbine stage;

an opening in the steam guide for fluidically actuating the main flow, wherein the opening is located downstream from the steam guide inlet and upstream from a point where boundary layer separation would occur along a steam guide without the opening;

a plurality of openings in the steam guide, each opening located equidistantly from the exhaust hood inlet; and an annular manifold surrounding the plurality of openings, the annular manifold collecting fluid from an outside source for distributing to the openings.

48. The steam turbine of claim 47 further comprising tubes connecting the annular manifold to the openings.

49. The steam turbine of claim 48 wherein the tubes are curved convexly relative to the main flow.

50. The steam turbine of claim 47 wherein the annular manifold is at least 15 times greater in diameter than a diameter of each opening.

51. A method of improving diffuser performance comprising:

allowing a main flow to pass through the diffuser;

providing an opening in a diffuser wall;

selecting a fluid source;

injecting fluid into the opening for preventing separation of the main flow from the diffuser wall; and, directing the fluid at an angle relative to the main flow and relative to the diffuser wall, wherein directing the fluid at an angle comprises sending the fluid through a curved passageway having a curvature which is convex relative to the main flow prior to injecting fluid into the opening.

52. The method of claim 51 further comprising positioning a centerbody within the diffuser and providing an opening in a wall of the centerbody.

53. The method of claim 52 further comprising injecting fluid through the opening of the centerbody and into the diffuser.

54. The method of claim 51 wherein injecting fluid into the opening comprises injecting a steady jet of fluid at constant pressure.

55. The method of claim 51 wherein selecting a fluid source comprises selecting a source from the turbine upstream of the diffuser and plumbing the fluid from the source to the opening.

56. The method of claim 51 wherein selecting a fluid source comprises connecting the output of an independent booster unit to the opening.

57. A method of improving diffuser performance comprising:

allowing a main flow to pass through the diffuser;

providing an opening in a diffuser wall;

selecting a fluid source;

injecting fluid into the opening for preventing separation of the main flow from the diffuser wall, wherein injecting fluid into the opening comprises injecting a pulsating jet of fluid; and, directing the fluid at an angle relative to the main flow and relative to the diffuser wall.

58. A method improving diffuser performance comprising:

allowing a main flow to pass through the diffuser;

providing an opening in a diffuser wall;

selecting a fluid source, wherein selecting a fluid source comprises redirecting fluid exiting the diffuser to the opening;

injecting fluid into the opening for preventing separation of the main flow from the diffuser wall; and, directing the fluid at an angle relative to the main flow and relative to the diffuser wall.

* * * * *

UNITED STATES PATENT AND TRADEMARK OFFICE

CERTIFICATE OF CORRECTION

PATENT NO. : 6,896,475 B2
DATED : May 24, 2005
INVENTOR(S) : Paolo Graziosi et al.

It is certified that error appears in the above-identified patent and that said Letters Patent is hereby corrected as shown below:

Column 15,
Line 1, incorrectly reads "The A diffuser augmented with fluidic actuation, the" should read -- A diffuser augmented with fluidic actuation, the --

Signed and Sealed this

Ninth Day of August, 2005

JON W. DUDAS
*Director of the United States Patent and Trademark Office*